US007799402B2

(12) United States Patent
Redmann et al.

(10) Patent No.: US 7,799,402 B2
(45) **Date of Patent: *Sep. 21, 2010**

(54) REDUCED PLY SEPARATION TAIL SEAL

(75) Inventors: Teresa M. Redmann, New London, WI (US); Richard D. Huss, Appleton, WI (US); Brian J. Schuh, Appleton, WI (US); Terry P. Witkowski, Neenah, WI (US)

(73) Assignee: Georgia-Pacific Consumer Products LP, Atlanta, GA (US)

( * ) Notice: Subject to any disclaimer, the term of this patent is extended or adjusted under 35 U.S.C. 154(b) by 654 days.

This patent is subject to a terminal disclaimer.

(21) Appl. No.: 11/633,352

(22) Filed: Dec. 4, 2006

(65) Prior Publication Data

US 2007/0095461 A1 May 3, 2007

Related U.S. Application Data

(63) Continuation of application No. 11/077,832, filed on Mar. 11, 2005, which is a continuation-in-part of application No. 11/007,004, filed on Dec. 7, 2004.

(60) Provisional application No. 60/553,653, filed on Mar. 15, 2004.

(51) Int. Cl.

| | |
|---|---|
| ***B28B 21/00*** | (2006.01) |
| ***B65D 65/28*** | (2006.01) |
| ***B65D 85/00*** | (2006.01) |
| ***B65D 85/67*** | (2006.01) |

(52) U.S. Cl. ..... 428/43; 156/184; 156/357; 206/389; 206/394; 206/411; 206/813; 225/90; 242/160.1; 242/556; 428/98; 428/131; 428/156; 428/537.5

(58) Field of Classification Search ..... 428/43, 428/573.5, 98, 131, 156; 206/389, 394, 411, 206/813; 225/90; 242/160.1, 556; 156/184, 156/357

See application file for complete search history.

(56) References Cited

U.S. PATENT DOCUMENTS

| | | | |
|---|---|---|---|
| 1,465,786 | A | 8/1923 | Wheildon |
| 3,044,532 | A | 7/1962 | Ghisoni |

(Continued)

FOREIGN PATENT DOCUMENTS

| | | | |
|---|---|---|---|
| DE | 19528264 | A1 | 4/1996 |

(Continued)

OTHER PUBLICATIONS

Translation of JP 2001017344 A (Jan. 2001) (Ishizu), see above.*

*Primary Examiner*—Brent T O'Hern
(74) *Attorney, Agent, or Firm*—Michael W. Ferrell; Robert S. Alexander

(57) ABSTRACT

Easy starting rolls of perforated tissue product which have a reduced tendency to ply separate are formed with an adhesively secured doubled over tail tab folded against the roll. The strength and location of the bonds are controlled by controlling the penetration of the adhesive into the tissue. The dry tensile strength of the projecting folded over tail tab exceeds 400 g/in and the caliper thereof exceeds one mil The adhesive bonds are spaced away from lines of perforation joining sheets in the initial sheets of the roll.

137 Claims, 22 Drawing Sheets

U.S. PATENT DOCUMENTS

| | | | |
|---|---|---|---|
| 3,134,980 | A | 5/1964 | Alexander |
| 3,393,105 | A | 7/1968 | Tellier, Jr. |
| 3,470,052 | A | 9/1969 | Herman |
| 3,532,573 | A | 10/1970 | Herman |
| 3,553,055 | A | 1/1971 | Janik |
| 3,616,034 | A | 10/1971 | Obergfell |
| 3,734,423 | A | 5/1973 | Kataoka |
| 3,791,907 | A | 2/1974 | Marcalus |
| 3,806,388 | A | 4/1974 | Contini |
| 3,898,920 | A | 8/1975 | Zucker |
| 3,912,571 | A | 10/1975 | Hartbauer et al. |
| 3,935,057 | A | 1/1976 | Gray |
| 3,951,890 | A | 4/1976 | Reilly et al. |
| 3,960,272 | A | 6/1976 | Hartbauer et al. |
| RE29,052 | E | 11/1976 | Bucalo |
| 3,994,396 | A | 11/1976 | Reilly et al. |
| 4,026,752 | A | 5/1977 | Hartbauer et al. |
| 4,244,767 | A | 1/1981 | Hoeboer |
| 4,299,642 | A | 11/1981 | Berkholtz |
| 4,332,324 | A | 6/1982 | Howard et al. |
| 4,475,974 | A | 10/1984 | Perini |
| 4,581,083 | A | 4/1986 | Schutz et al. |
| 4,802,632 | A | 2/1989 | Fukuda et al. |
| 4,931,130 | A | 6/1990 | Biagiotti |
| 4,963,223 | A | 10/1990 | Biagiotti |
| 5,018,679 | A | 5/1991 | Saiga et al. |
| 5,242,525 | A | 9/1993 | Biagiotti |
| 5,259,910 | A | 11/1993 | Biagiotti |
| 5,328,544 | A | 7/1994 | Weinert |
| 5,474,646 | A | 12/1995 | Matteucci |
| 5,558,223 | A | 9/1996 | Stefanescu |
| 5,573,615 | A | 11/1996 | Vigneau et al. |
| 5,643,398 | A | 7/1997 | Lumberg |
| 5,653,401 | A | 8/1997 | Biagiotti |
| 5,679,206 | A | 10/1997 | Glass |
| 5,681,421 | A | 10/1997 | Biagiotti |
| 5,702,555 | A | 12/1997 | Caudal et al. |
| RE35,729 | E | 2/1998 | Biagiotti |
| 5,716,489 | A | 2/1998 | Biagiotti |
| 5,759,326 | A | 6/1998 | Vigneau |
| 5,800,652 | A | 9/1998 | Vigneau et al. |
| 6,050,519 | A | 4/2000 | Biagiotti |
| 6,143,111 | A | 11/2000 | Biagiotti |
| 6,168,679 | B1 | 1/2001 | Biagiotti |
| RE37,039 | E | 2/2001 | Biagiotti |
| 6,342,297 | B1 | 1/2002 | LaBrash |
| 6,372,064 | B1 | 4/2002 | Butterworth et al. |
| 6,453,965 | B1 | 9/2002 | White |
| 6,666,249 | B2 | 12/2003 | White |
| 2003/0118767 | A1 | 6/2003 | Krzysik et al. |
| 2003/0207027 | A1 | 11/2003 | Gunn et al. |
| 2003/0215605 | A1 * | 11/2003 | Muller ..... 428/138 |

FOREIGN PATENT DOCUMENTS

| | | | |
|---|---|---|---|
| JP | 5070006 | | 3/1993 |
| JP | 2001-17344 | A | 1/2001 |
| JP | 2001017344 | A * | 1/2001 |
| JP | 2001-120459 | A | 5/2001 |

* cited by examiner

FIG. 27A
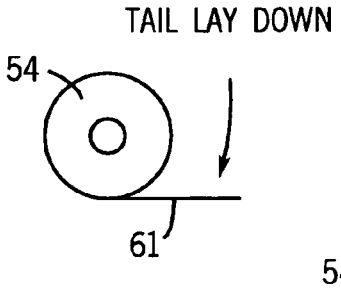
FIG. 27B
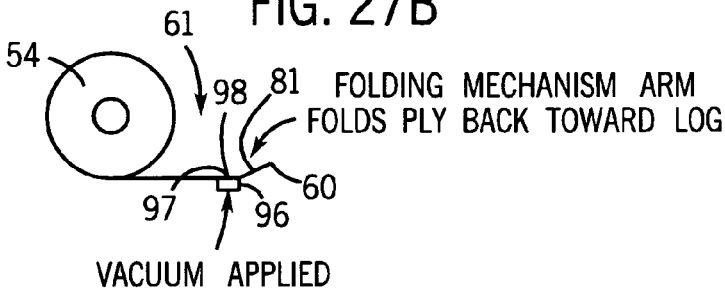
FIG. 27C
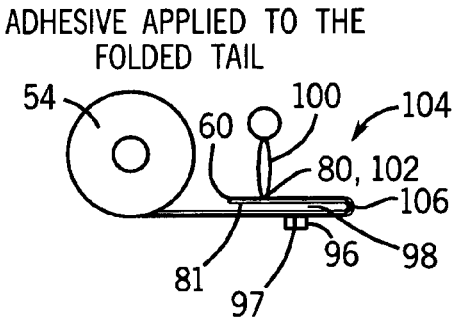
FIG. 27D
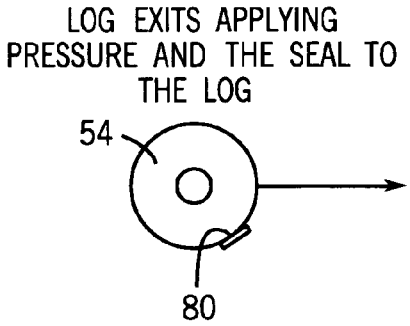
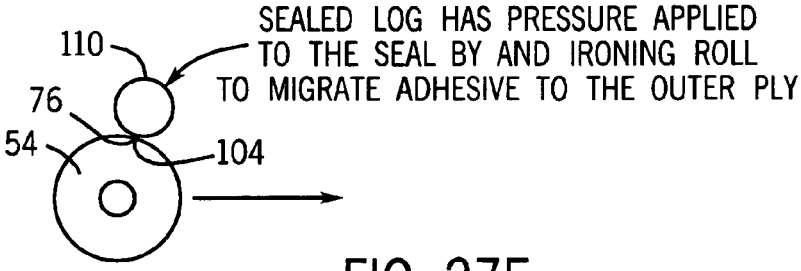
FIG. 27E

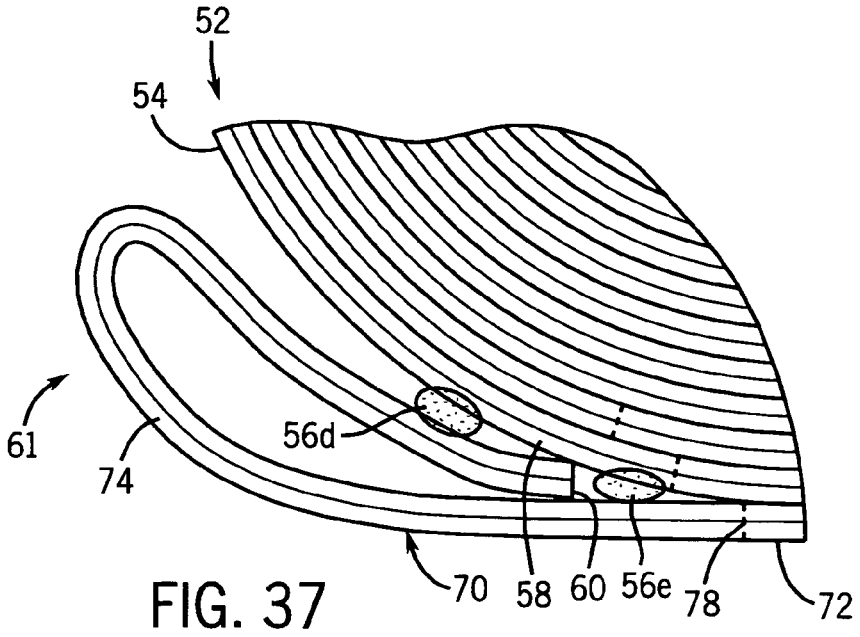
FIG. 37
FIG. 38
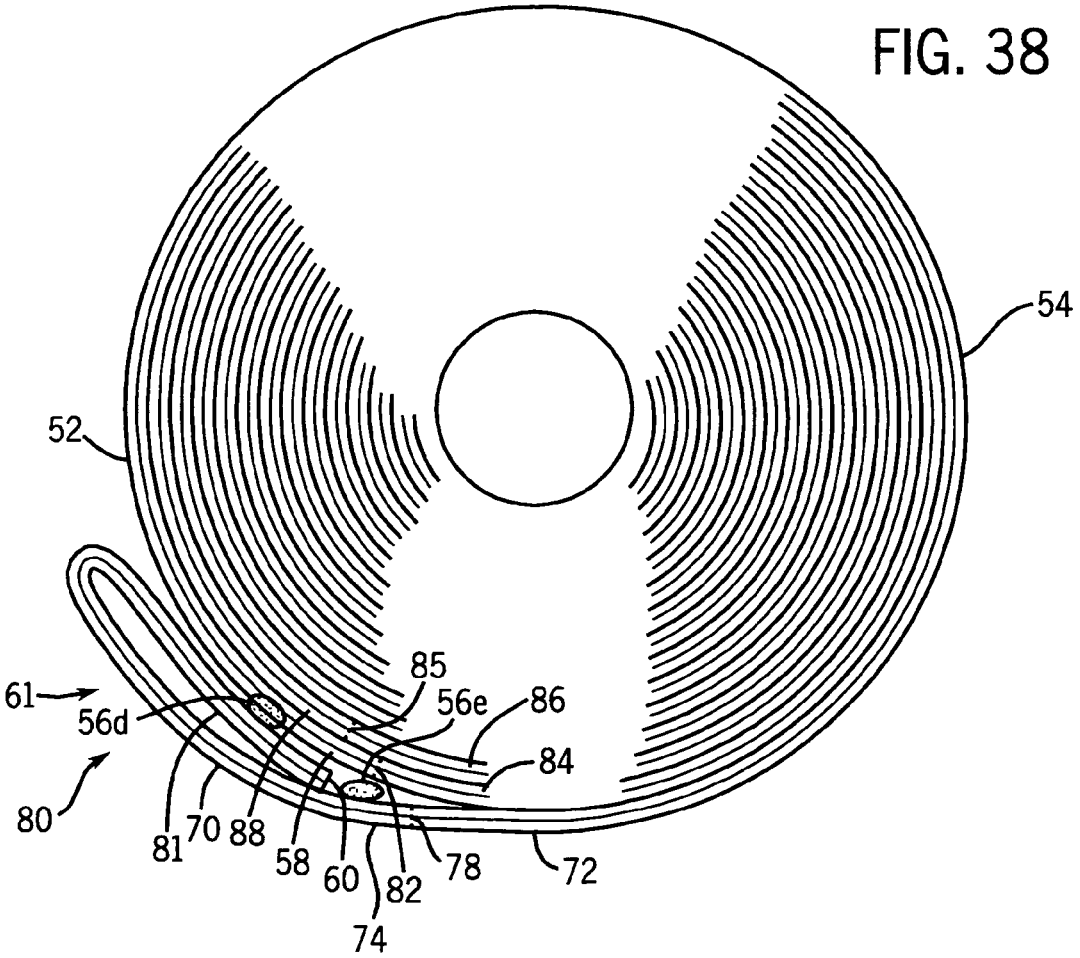

REDUCED PLY SEPARATION TAIL SEAL

This application is a continuation of U.S. patent application Ser. No. 11/077,832, filed Mar. 11, 2005, which is a continuation-in-part of co-pending U.S. patent application Ser. No. 11/007,004, filed Dec. 7, 2004, which claims the benefit of the filing date of U.S. Provisional Patent Application Ser. No. 60/553,653, filed Mar. 15, 2004, all of which are incorporated herein by reference. The priorities of the foregoing applications are hereby claimed.

Bath tissue, especially in the better grades, is commonly sold as rolls of multi-ply tissue shrink-wrapped in polyethylene. Typically, when the parent roll of tissue is converted to a "log", the outermost layer in these rolls will be lightly adhered to the adjacent inner layer to form a tail seal. Tail sealing is intended to not only prevent the loose end of the roll from flopping about and interfering with the manufacturing process but also to insure that the package is attractive while facilitating handling of loose tissue rolls by the consumer. However, imperfect tail sealing often leads to numerous consumer complaints when it interferes with easy removal of the bath tissue from the roll. In the case of multi-ply products, complaints about ply separation are especially common; but surprisingly, even when consumers are questioned about ply-separation with regard to single ply products, the number of complaints registered is not insignificant. Further, there appears to be a perverse relationship between ply separation and ease of starting the roll, "improved" tail seal often leading to issues around the ease of starting the roll. It is believed that these complaints reflect issues relating to the technology used for tail sealing, as a poor tail seal often makes it difficult to remove tissue from the roll.

In many cases, we found that if the penetration of the adhesive used for tail sealing is not properly controlled, the adhesive will penetrate through an odd number of plies on multi-ply products, thus leading the consumer to unroll the inner ply of one layer from the roll simultaneously with the outer ply of the next layer. However, when this happens, because the tissue on the roll bears perforation lines which are meant to ease removal of single sheets of a tissue, as more and more tissue is removed from roll, it becomes increasingly difficult for the consumer to remove a length of bath tissue from the roll, because the distance increases slightly between perf lines on the inner ply of one layer and the outer ply of the other with every layer of tissue which is removed. In other cases, even with single ply products, the tail seal will not release from portions of the roll leading to longitudinal tearing of the roll.

In other cases, we have found that if the strength of the adhesive bond securing the tail tab to the body of the roll is insufficient, the tail will be detached from the body of the roll during the manufacturing process and interfere therewith. Accordingly, it can be appreciated that too weak a tail seal can be as disadvantageous as too strong a tail seal.

We have found that we can alleviate many ply separation and tail-seal problems by insuring that the penetration of the adhesive is controlled. It is particularly advantageous that it be controlled such that an even number of bonds are formed between the plies underlying the bond sealing the tail to the outermost layer of the roll. We can address many of the tearing problems by providing a doubled over tail seal with controlled penetration and distribution of adhesive such that the bonds formed are spread over a wide area of the doubled over tail and do not have enough strength per unit area to tear the underlying tissue. In preferred embodiments, we can further alleviate difficulties by first forming an inward transverse fold across the projecting tail of the multi-ply tissue log, applying a controlled penetration adhesive to the inner surface of the inwardly folded portion of the tail—the surface of the folded portion which will contact the log when the tail is respooled against it and respooling the tail against the log such that: controlled strength bonds are formed between not only the inner surface of the inwardly folded portion of the tail and the log; but also between the inwardly folded portion of the tail and the outer portion of the tail, thereby forming a well-sealed, strong two layer tail and a weaker bond between that tail and the underlying tissue; so that the underlying tissue is neither torn nor ply-separated when the tail is pulled away from it. By controlling the rheological properties of the controlled penetration adhesive (primarily by controlling dilution) along with the amount of adhesive applied and distributing the adhesive over a large area, it is possible to control the strength of the bond per unit area between the inner surface of the inwardly folded portion of the tail and the underlying tissue and, in preferred embodiments, to ensure that the strength per unit area of the bond between the sheet of tissue and the sheet of tissue underlying it is low enough that it will neither tear the underlying sheet nor induce ply separation in it. Preferably, the dry tensile strength of the projecting folded over tail exceeds 400 g/in, more preferably 500 g/in while the caliper thereof exceeds one mil, more preferably two mils, while the strength of the adhesive bond adhering the distal portion of the folded exterior ply to the exterior ply of the next interior sheet of multi-ply tissue inwardly adjacent thereto is preferably, no more than about 75% of the machine direction dry tensile strength of the tissue product while preferably, the area of said adhesive bond is approximately the width of the roll and extends from about ⅛" to about ½" in the machine direction. In other preferred embodiments, the medial portion of the initial sheet comprises a folded tail tab having a dry tensile strength of at least 1¼, more preferably 1½, still more preferably 2 times the strength of the adhesive bond adhering the distal portion of the folded exterior ply to the exterior ply of the next interior sheet of multi-ply tissue inwardly adjacent thereto. When the adhesive bond extends over an area spaced from the distal edge of the initial sheet, the strength of the adhesive bond extending over an area spaced from the distal edge of the initial sheet adhering the distal portion of the folded exterior ply to the exterior ply of the next interior sheet of multi-ply tissue inwardly adjacent thereto is at least about 50 g/3", more preferably 60 g/3" but no more than about 300 g/3", more preferably no more than 200 g/3", even more preferably no more than about 150 g/3" and still more preferably no more than about 120 g/3". Most preferably, the strength of the adhesive bond extending over an area spaced from the distal edge of the initial sheet adhering the distal portion of the folded exterior ply to the exterior ply of the next interior sheet of multi-ply tissue inwardly adjacent thereto is at least about 70 g/3" but no more than about 110 g/3". Desirably, the strength of the adhesive bond extending over an area spaced from the distal edge of the initial sheet adhering the distal portion of the folded exterior ply to the exterior ply of the next interior sheet of multi-ply tissue inwardly adjacent thereto is at least about 50 g/3" but no more than about 300 g/3", while the strength of the interior subsidiary bond is no more than about 40 g/3".

It is particularly advantageous to insure that the glue line is displaced from the adjacent perf lines joining sheets together in not only the outermost layer (both plies) of the roll but also from the perf lines joining sheets together in both adjacent inner layers (four plies) of the roll. In one preferred embodiment, the glue line will be closely adjacent to, or even perhaps overlapping, the free end of the tissue as it lies against the tail.

In another preferred embodiment, the glue line will be spaced away from the free end of the tissue as it lies against the tail.

In one alternative embodiment, the glue is applied in multiple lines across the width of the tissue to better control both glue penetration and the precise location of the adhesive bonds formed thereby. If multiple glue lines are used, a first may be applied to the distal portion of the inner (upper) surface of the inwardly folded portion of the initial sheet in roll (as it is unrolled) closely adjacent to the free end thereof and another on the upper surface of the medial or proximal portion (depending upon the length of the folded over portion of the tail) of the initial sheet in the roll closely adjacent to the free end thereof. Optionally, an additional line of adhesive may be applied to the distal portion of the inner surface of the inwardly folded portion of the initial sheet in the roll closely adjacent to the first glue line laid down thereupon but spaced slightly further from the free end of the distal portion of the initial sheet.

BRIEF DESCRIPTION OF THE DRAWINGS

FIG. 27 illustrates the operation of one mechanism for forming the folded over tail-seal tab of the present invention.

FIG. 37 is a schematic sectional view illustrating the free end of the tissue roll of FIG. 36 after it is spooled against the underlying sheets in the roll.

FIG. 38 is a schematic sectional view illustrating the free end of the tissue roll of FIG. 36 after pressing against the body of the roll.

DESCRIPTION OF PREFERRED EMBODIMENTS

Figure 1:
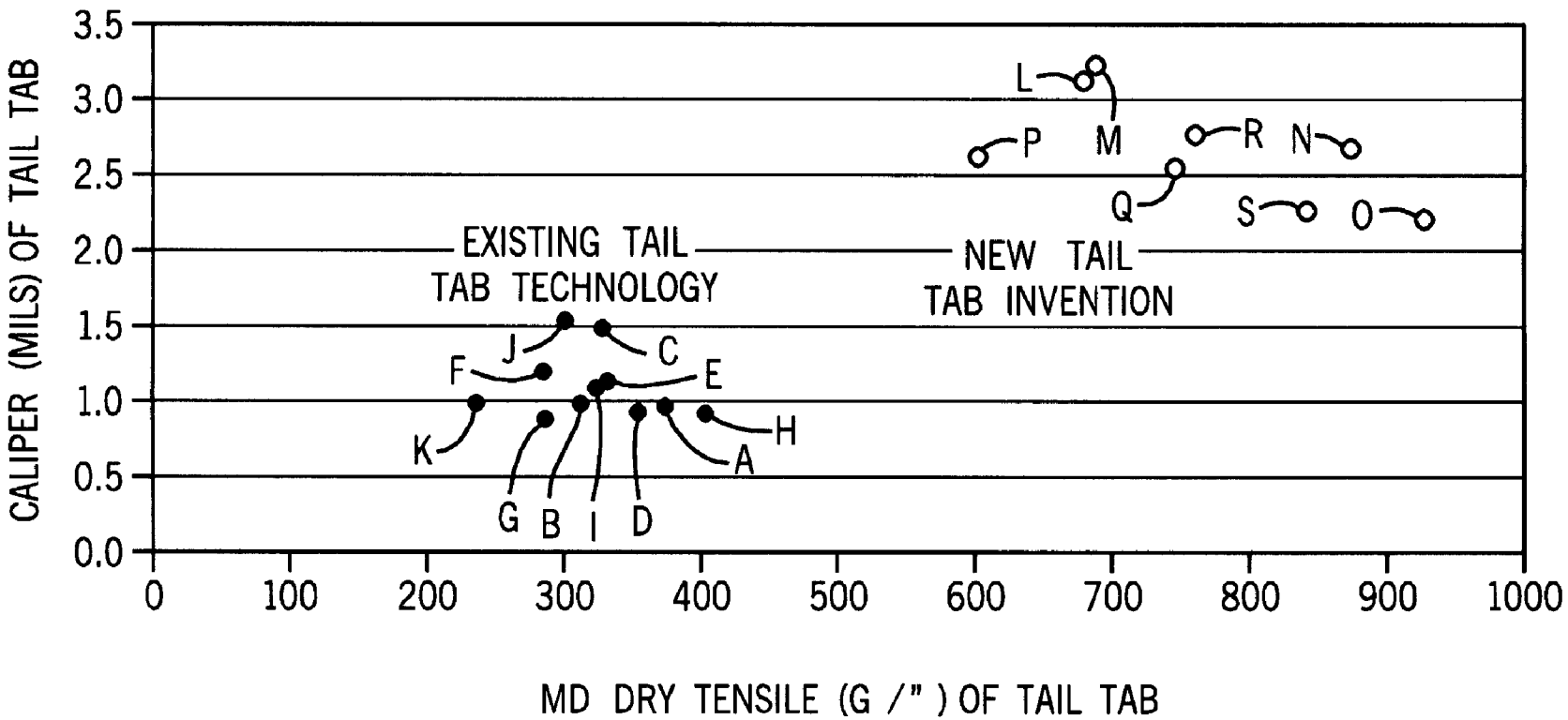
FIG. 1 illustrates the dramatically improved strength and thickness of the tail seal tab formed by the method of the present invention as compared to known tabs.

FIG. 1 compares the caliper and strength of preferred embodiments of tail-tabs manufactured according to the present invention to the strength and caliper of tail-tabs of current commercially available bath tissue products. From this, it can be appreciated that the technology of the present invention can provide a tail-tab having markedly improved strength and caliper over currently available products. For this test, a 3 mm steel ball weighing 0.1093 grams in a Krautkramer MTM10 is used to measure the caliper of a single folded over tail tab (4 plies) of the present invention as compared to 1 or 2 ply tabs of existing products.

Figure 2:
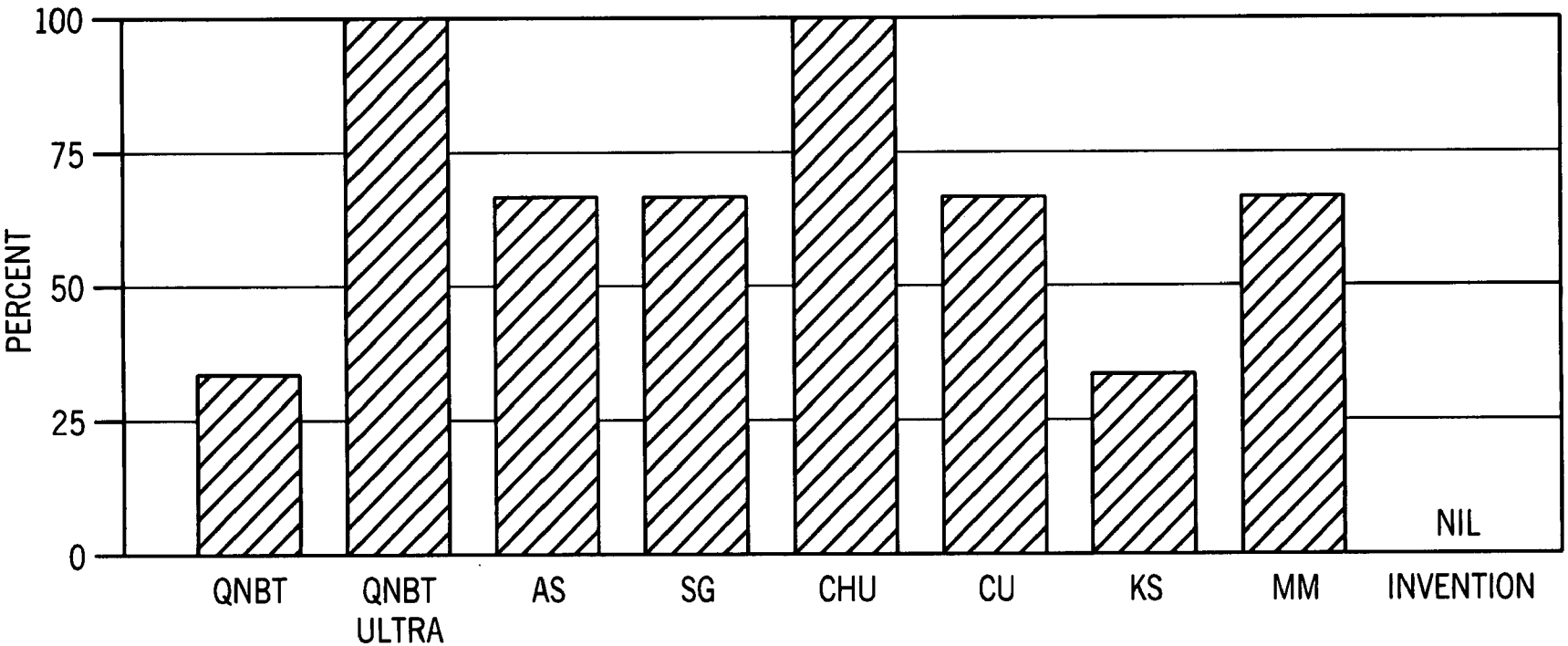
FIG. 2 is a bar graph illustrating the dramatic reduction in unwinding problems achieved by the practice of the present invention as compared to commercially available competitive products as well as products previously produced by the assignee of the present invention.

FIG. 2 illustrates the results of a quality study done on various brands of bath tissue to determine frequency of tail separation with multi-ply products as compared to tissue the present invention which exhibited nil tail separation. The assignee of the present invention receives more complaints and negative comments from consumers regarding ply separation issues than any other quality related complaint. It can thus be appreciated that practice of the present invention makes it possible to alleviate, if not eliminate, problems of this nature experienced by the major manufacturers of premium bath tissue products.

Figure 3:
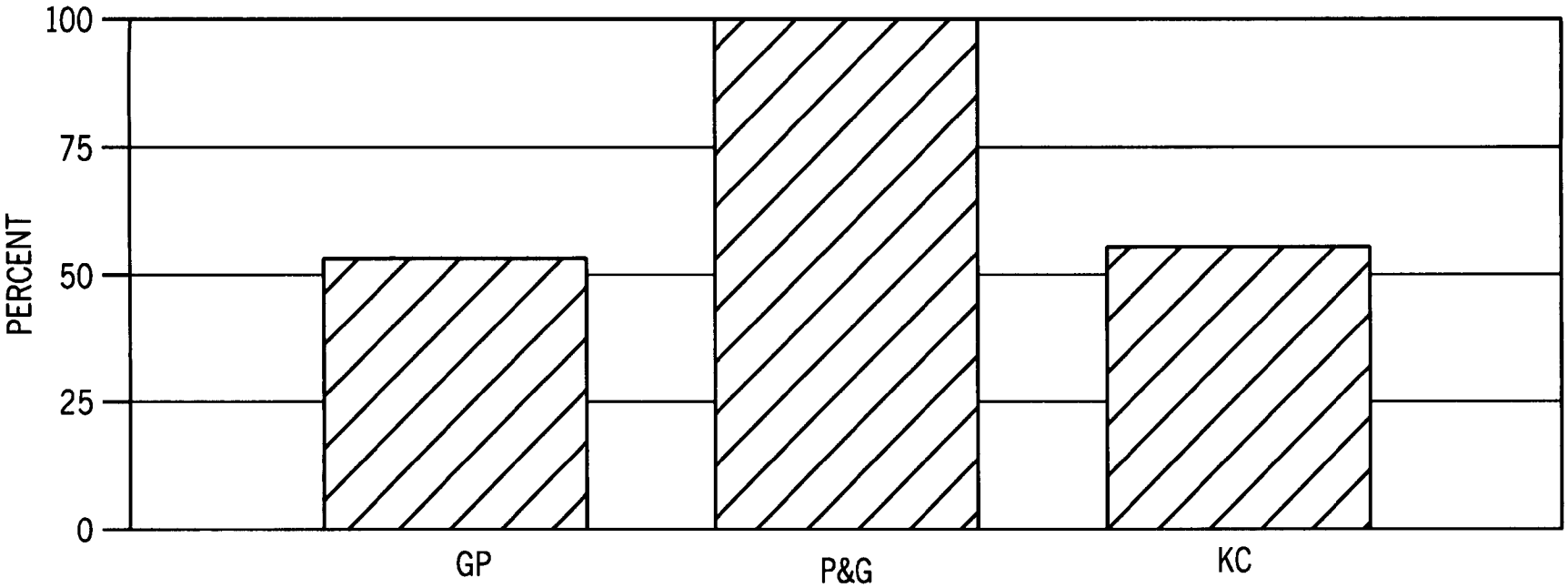
FIG. 3 is a bar graph illustrating the frequency of occurrence of ply separation issues with all of the major manufacturers of two-ply tissues.

FIG. 3 illustrates frequency of ply-separated tail tabs encountered with the multi-ply products of the three major manufacturers of premium bath tissue in United States. From the data, it can be appreciated that none of these manufacturers currently achieves reliable ply bonding in the tail tabs of their multi-ply products.

Figures 4, 5:
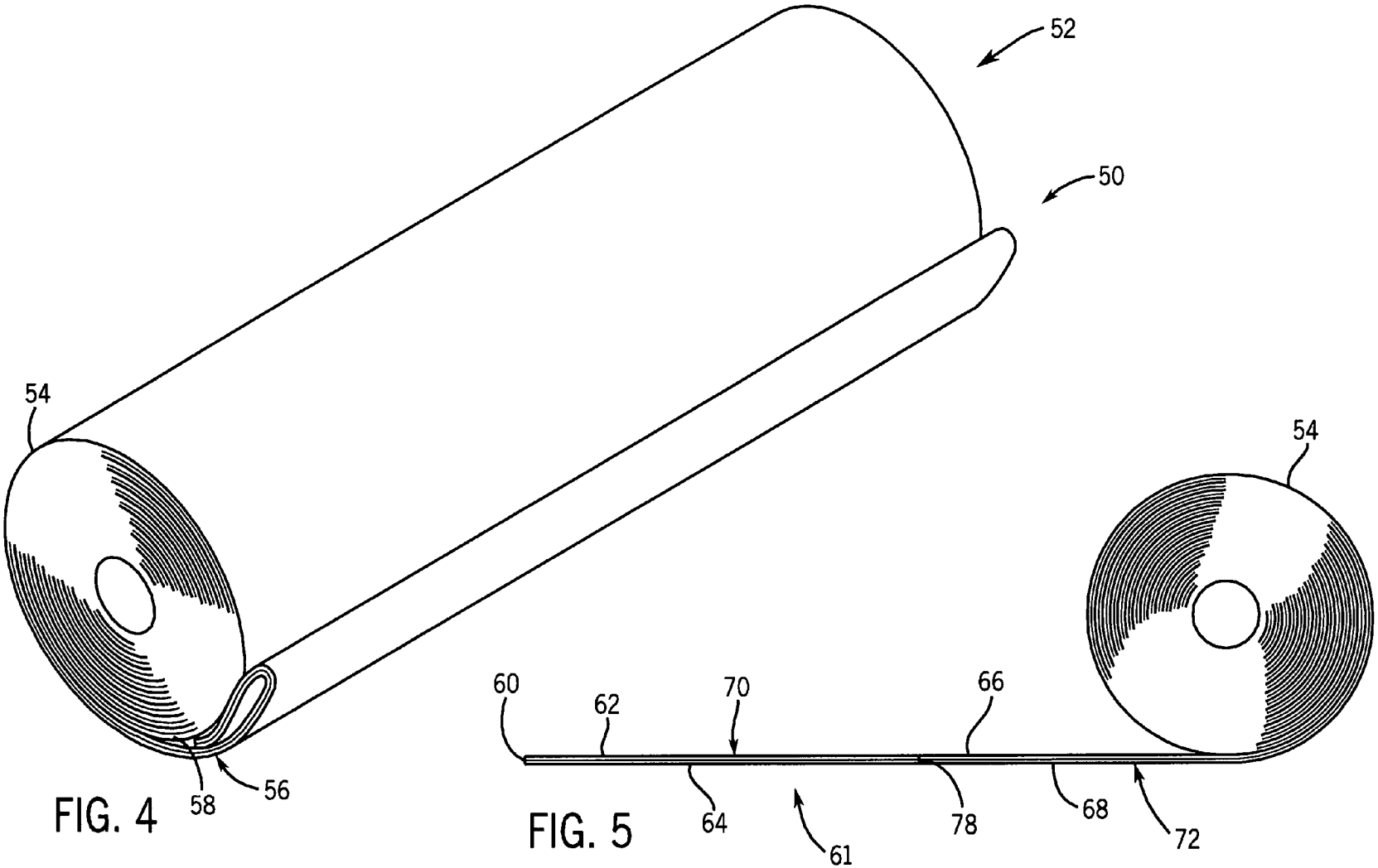
FIG. 4 is an isometric perspective illustrating a bath tissue roll having a doubled over tail tab incorporating the tail seal of the present invention.
FIG. 5 is a schematic elevational view of a tissue log having a projecting tail.

FIG. 4 illustrates a roll of tissue according to one embodiment of the present invention in which the folded over tail-tab 50 projects from body 52 of tissue log 54 at glue line 56 where tail-tab 50 is joined to sheet 58 in the first underlying layer. It is greatly preferred that the folded over tail-tab 50 projects from body 52 of tissue log 54 by from at least about ¼" to about 2¼".

FIG. 5 schematically illustrates tissue log 54 in which free end 60 of tissue-tail 61 comprising plies 62, 64, 66 and 68 of tissue sheets 70 and 72 project from tissue log 54 having been unspooled to facilitate a tail sealing operation of the present invention.

Figure 6:
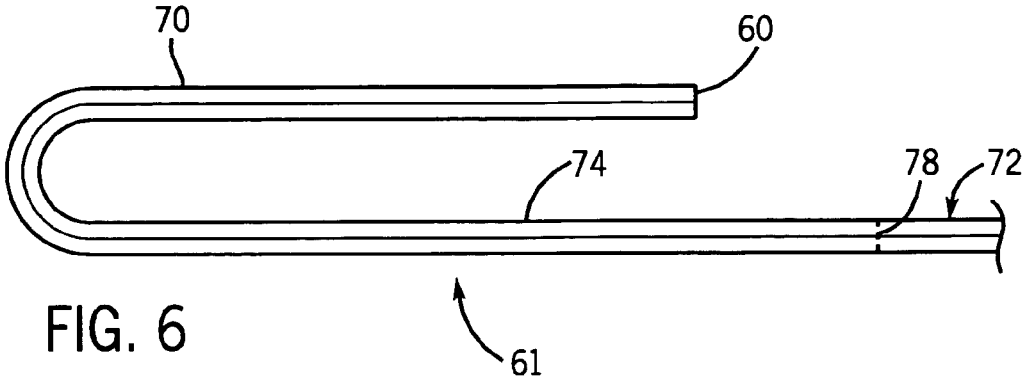
FIG. 6 is a schematic elevational view of a tissue log having a distal portion of the initial sheet of the projecting tail folded inwardly.

FIG. 6 illustrates tissue log 54 of FIG. 5 in which free end 60 of initial sheet 70 of tissue tail 61 has been folded upwardly and inwardly against itself whereby, upon respooling, free end 60 of initial sheet 70 of tissue tail 61 will be trapped between proximal portion 74 of initial sheet 70 of tissue tail 61 and next adjacent underlying sheet 58 of tissue log 54.

Figure 7:
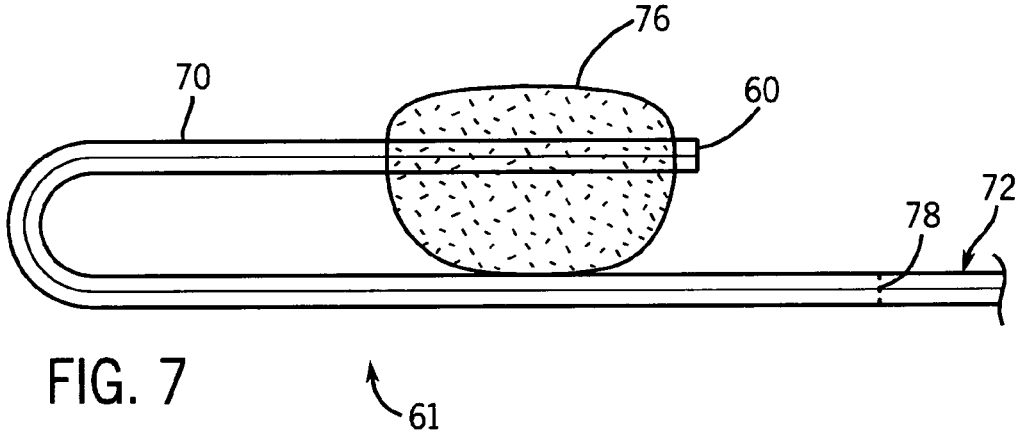
FIG. 7 is a schematic elevational view of the projecting tail after adhesive has been applied to the distal portion thereof with the adhesive lying against proximal portion of the initial sheet.

FIG. 7 illustrates tissue log 54 of FIG. 6 in which adhesive 76 has been applied closely adjacent free end 60 of initial sheet 70 of tissue tail 61 of tissue log 54. Note that adhesive is spaced away from perf line 78 between tissue sheets 70 and 72; so that when the user starts the roll, tendency for separation to occur along perf line 78 may be alleviated. In many applications, it will be preferred that adhesive 76 be applied either so closely adjacent free end 60 of initial sheet 70 of tissue tail 61 of tissue log 54 that upon respooling it will spread over free end 60 of initial sheet 70 or, alternatively, that it be applied overlapping free end 60 of initial sheet 70.

Figure 8:
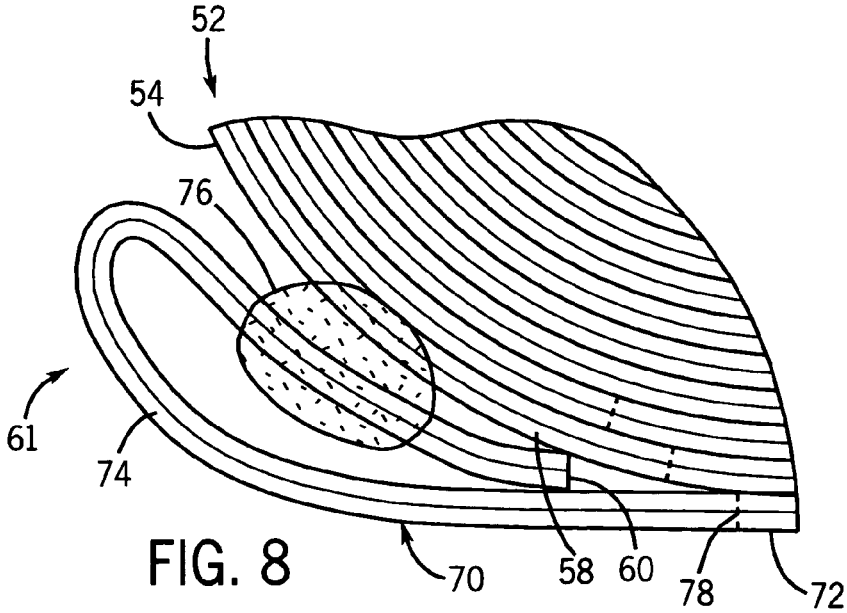
FIG. 8 is a schematic sectional view of the tissue log after the projecting tail has been respooled against it.

FIG. 8 illustrates tissue log 54 of FIG. 7 after free end 60 of initial sheet 70 of tissue tail 61 has been respooled against body 52 of tissue log 54 trapping free end 60 of initial sheet 70 of tissue tail 61 between proximal portion 74 of initial sheet 70 of tissue tail 61 and next adjacent underlying tissue sheet 58 of tissue log 54.

Figure 9:
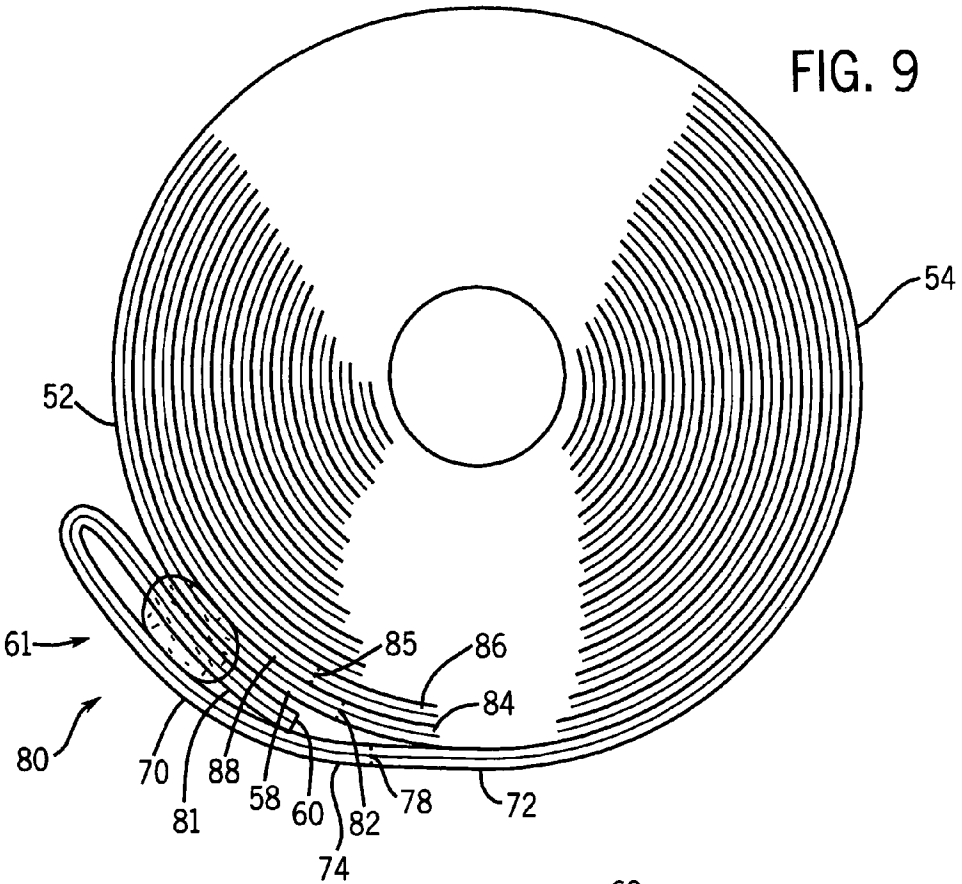
FIG. 9 is a schematic sectional view of the tissue log after the projecting tail has been pressed against it.

FIG. 9 schematically illustrates tissue log 54 of FIG. 8 after free end 60 of initial sheet 70 of tissue tail 61 has been pressed against body 52 of tissue log 54 illustrating how glue line 80 on distal portion 81 of initial sheet 70 of tissue tail 61 is spaced not only from perf line 78 between proximal portion 74 of initial sheet 70 of tissue tail 61 and penultimate sheet 72 of tissue tail 61 but also is spaced from perf line 82 between tissue sheets 58 and 84 in the next adjacent underlying layer of tissue log 54. Note also that adhesive originally placed on distal portion 81 of initial sheet 70 adjacent free end 60 of initial sheet 60 has penetrated underlying tissue sheet 58 and formed a weak bond between underlying tissue sheet 58 and tissue sheet 88. It is preferred that this bond have a strength of no more than about 25 g/3".

Figure 10:
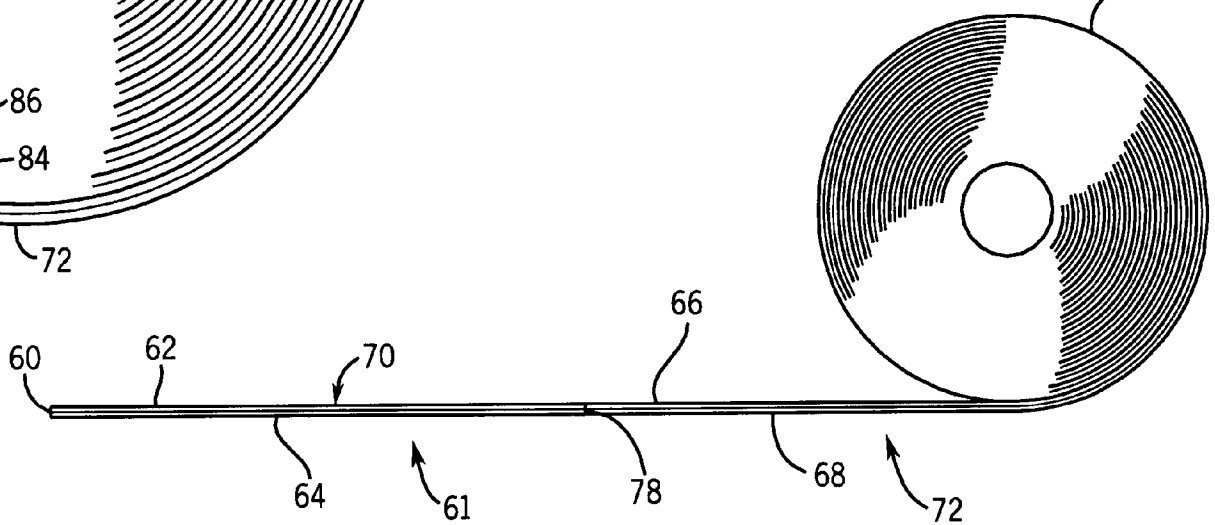
FIG. 10 is a schematic elevational view of a tissue log having a projecting tail.

FIG. 10 schematically illustrates stage one of an alternative tail-sealing process in which free end 60 of initial sheet 70 of tissue-tail 61 comprising plies 62, 64, 66 and 68 of tissue sheets 70 and 72 project from body 52 of tissue log 54 having been unspooled to facilitate an alternative tail sealing operation of the present invention.

Figure 11:
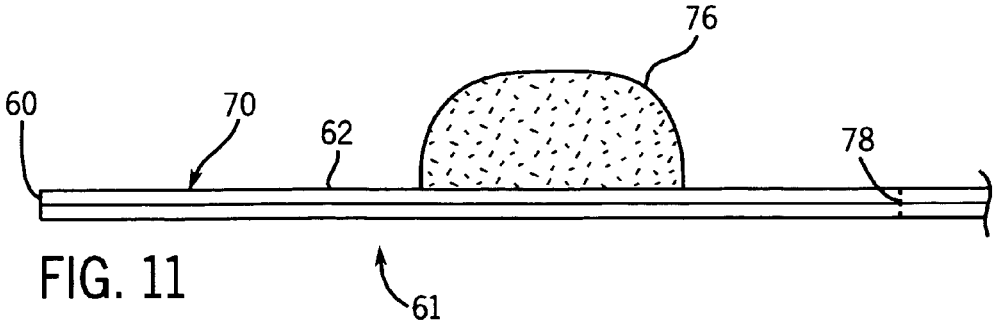
FIG. 11 is a schematic elevational view of a tissue log having a projecting tail with a line of adhesive applied thereto.

FIG. 11 schematically illustrates tissue log 54 of FIG. 10 in which adhesive 76 has been applied to ply 62 of tissue sheet 70 of tissue-tail 61. Note that adhesive 76 is spaced away from perf line 78.

Figure 12:
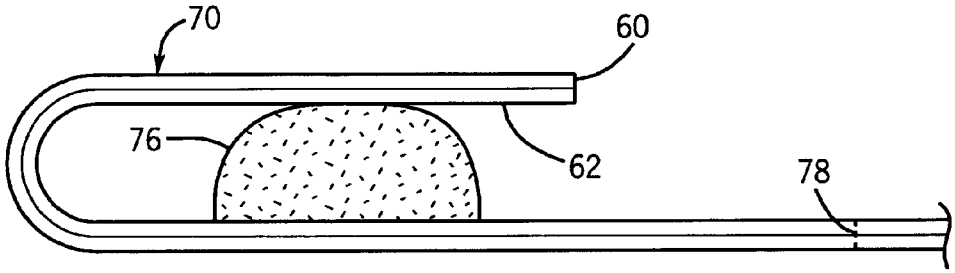
FIG. 12 is a schematic elevational view of the tissue log of FIG. 10 having a portion of the projecting tail folded inwardly over the line of adhesive.

FIG. 12 illustrates tissue log 54 of FIG. 11 after free end 60 of initial tissue sheet 70 has been folded back over adhesive 76 but adhesive 76 has not spread to extend to perf line 78.

Figure 13:
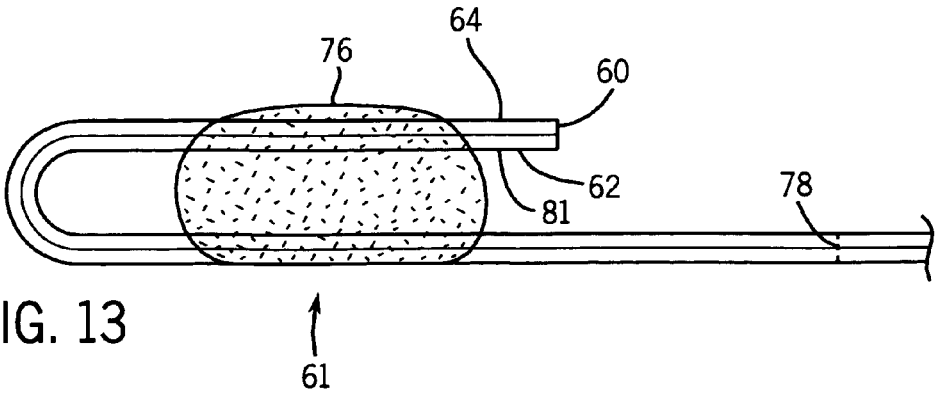
FIG. 13 is a schematic elevational view of the tissue log of FIG. 10 having a portion of the projecting tail folded inwardly over the line of adhesive after the adhesive has begun to penetrate the tissue plies.

FIG. 13 illustrates controlled penetration of adhesive 76 through both plies 62 and 64 of distal portion 81 of tail 61.

Figure 14:
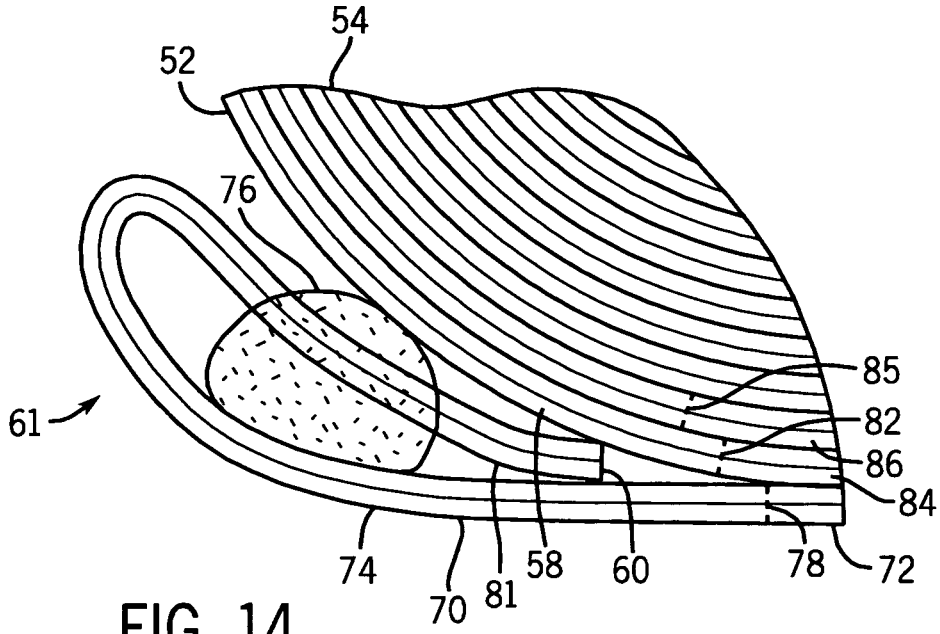
FIG. 14 is a schematic sectional view of the tissue log of FIG. 13 after the projecting tail has been respooled against it.

FIG. 14 illustrates respooled tissue log 54 of FIG. 13 after free end 60 of initial sheet 70 of tissue tail 61 has been respooled against body 52 of tissue log 54 trapping free end 60 and distal portion 81 of initial sheet 70 of tissue tail 61 between proximal portion 74 of initial sheet 70 of tissue tail 61 and next adjacent underlying sheet 58 of tissue log 54. Note that adhesive 76 is spaced away from perf line 78 joining tissue sheets 70 and 72.

Figure 15:
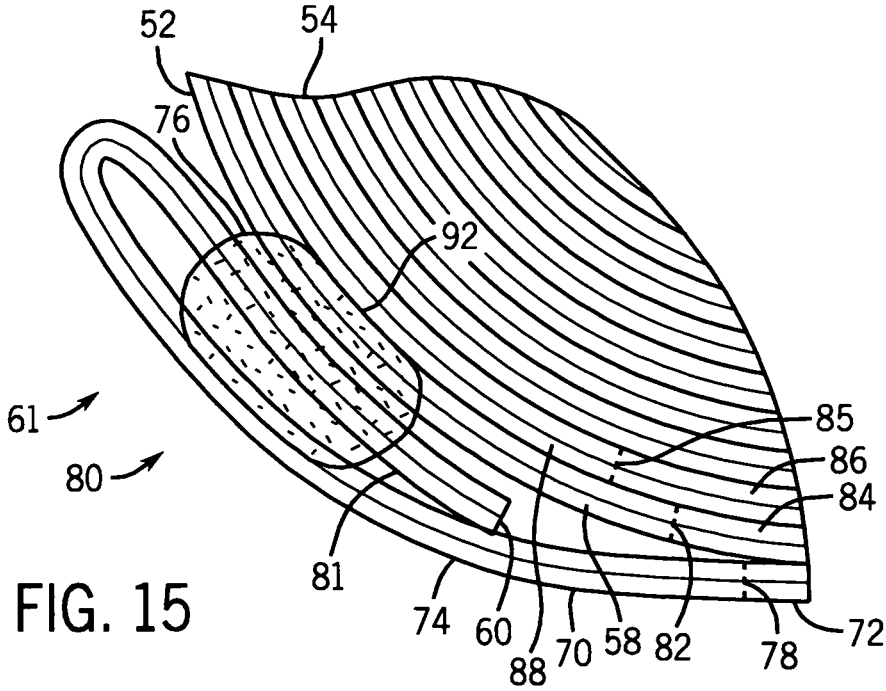
FIG. 15 is a schematic sectional view of the tissue log of FIG. 14 after the projecting tail has been respooled and pressed against it illustrating the bonds between the inwardly folded portion of the tail, the tissue sheet overlying it, the tissue sheet immediately underlying the inwardly folded portion of the tail and the sheet of tissue next underlying that sheet.

FIG. 15 illustrates tissue log 54 of FIG. 13 after free end 60 and distal portion 81 of initial sheet 70 of tissue tail 61 has been pressed against body 52 of tissue log 54 illustrating how glue line 80 on initial sheet 70 of tissue tail 61 is spaced not only from perf line 78 between proximal portion 74 of initial sheet 70 of tissue tail 61 and penultimate sheet 72 of tissue tail 61 but also is spaced from perf line 82 between tissue sheets 58 and 84 in next adjacent underlying layer of tissue log 54. Note also that adhesive 76 originally placed adjacent free end 60 of initial sheet 70 has penetrated underlying tissue sheet 58 and formed weak bond 92 between underlying tissue sheet 58 and tissue sheet 88 while weak bond 92 is spaced away from perf line 85 joining tissue sheets 88 and 86.

Figure 16:
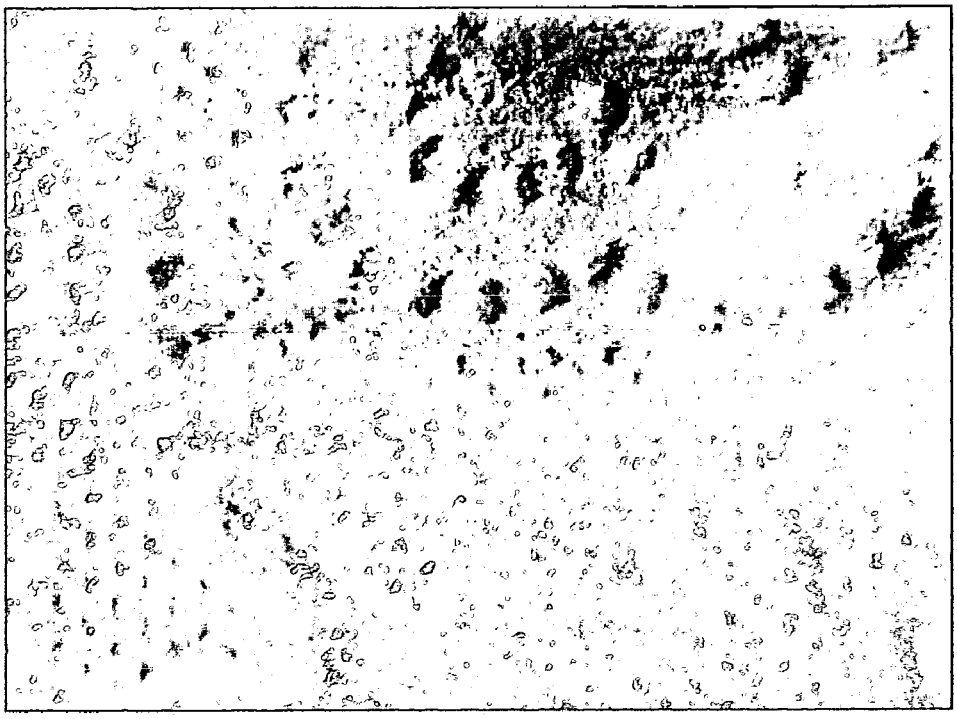
FIGS. 16, 17, 18 and 19 are 5× low angle illumination photomicrographs of various surfaces of the tail seal areas of a conventional roll of 2-ply bath tissue.
Figure 17:
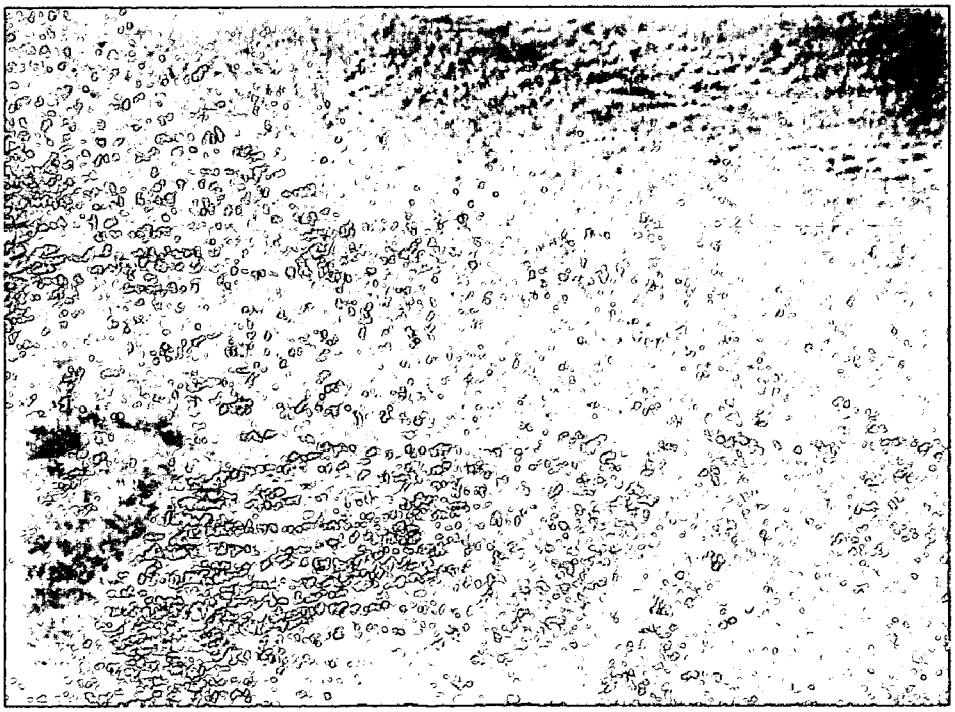
Figure 18:
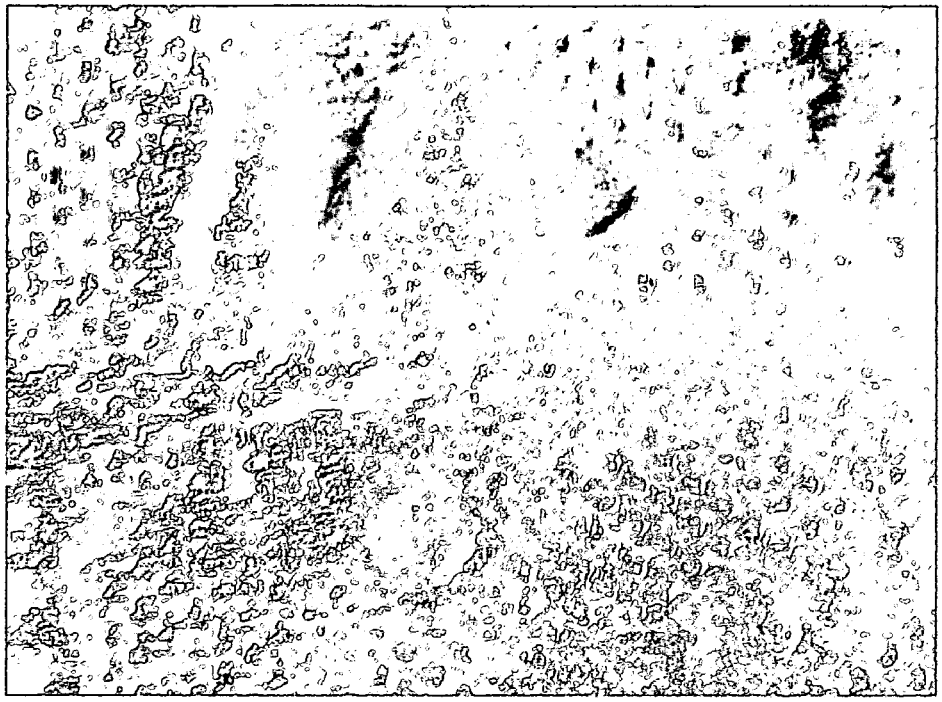
Figure 19:
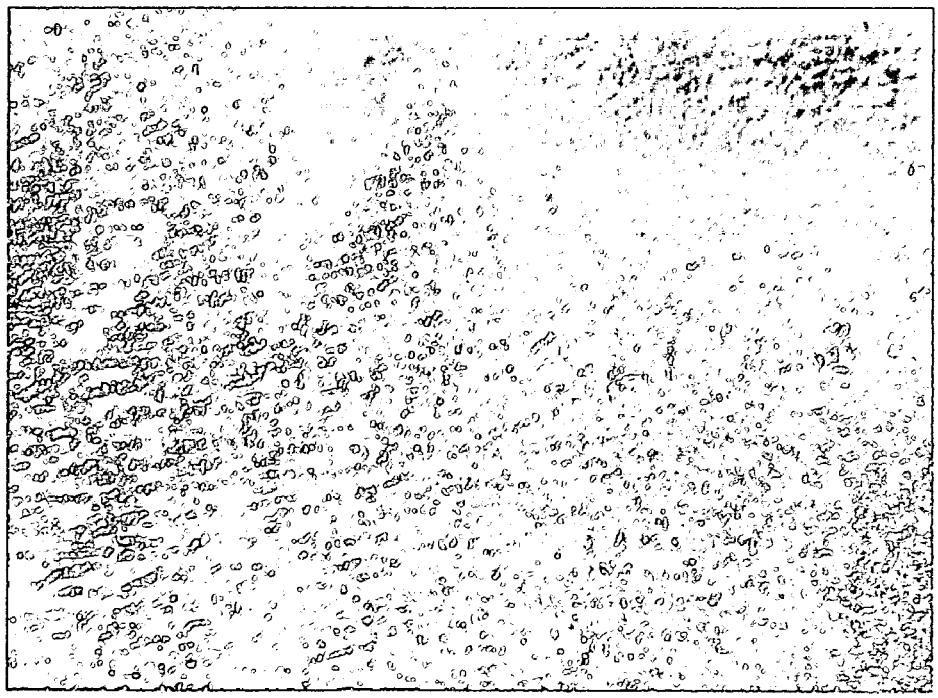

FIG. 16 is a 5× low angle illumination photomicrograph illustrating the surface of the outermost ply of tissue from a 2-ply tissue roll finished with conventional tail sealing technology—note that the tail sealing has formed an approximately 3 mm uniform channel across the width of the tissue sheet almost like a line of embossing. Although not illustrated, this channel can also be observed in the inner ply of the outer layer of tissue. In FIG. 17, the back (inner) side of the 2-ply tissue sheet of FIG. 16 is illustrated. The channel can be observed having the appearance of a debossed region congruent to the channel observed in FIG. 16 illustrating thus the depth and degree of penetration of adhesive into the tissue roll structure in a conventional tail-sealing operation. FIG. 18 is another low angle illumination photomicrograph which, in this case, illustrates the outer surface of the second layer in a roll sealed by conventional tail-sealing technology. It can be seen that a deep channel has been formed while the embossing has almost been obliterated by water in the adhesive contacting the sheet. FIG. 19 illustrates the channel formed on the backside of the inner sheet forming the tail-seal.

Figure 20:
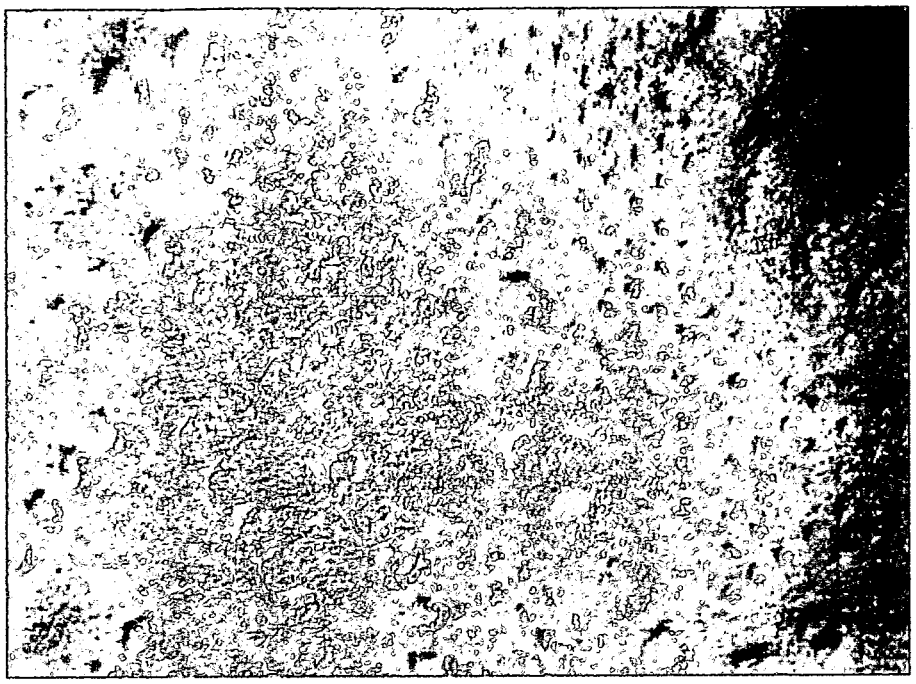
FIGS. 20, 21, 22 and 23 are 5× low angle illumination photomicrographs of various surfaces of the tail seal areas of a roll of 2 ply bath tissue sealed according to one embodiment of the present invention.
Figure 21:
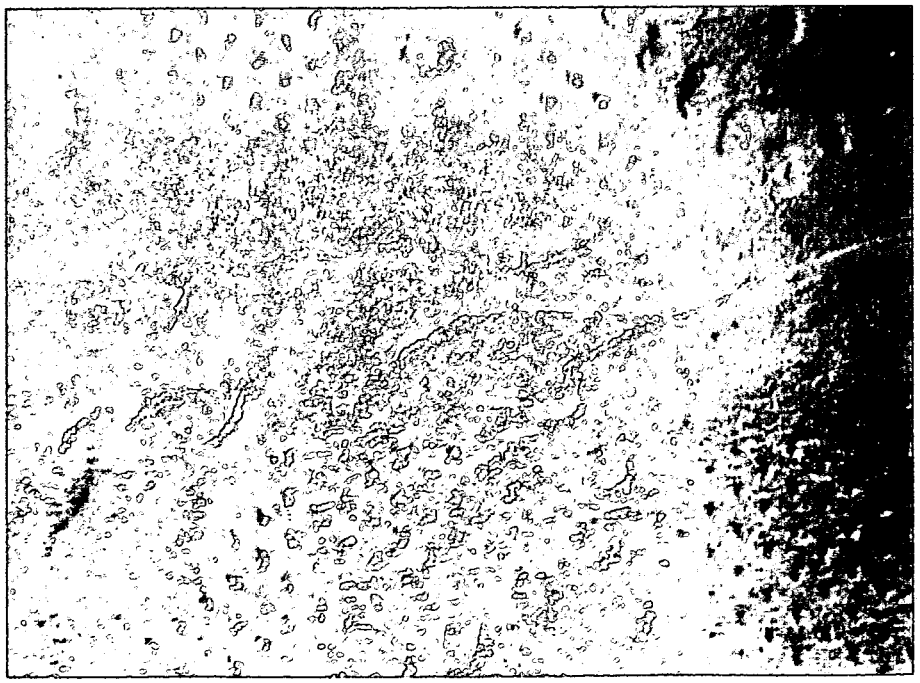
Figure 22:
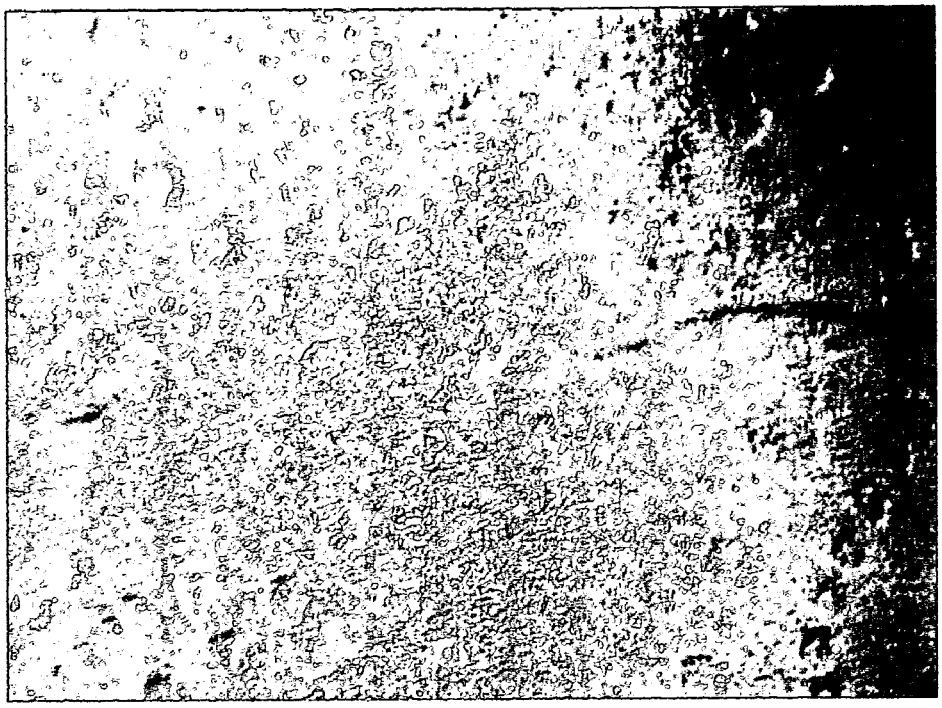
Figure 23:
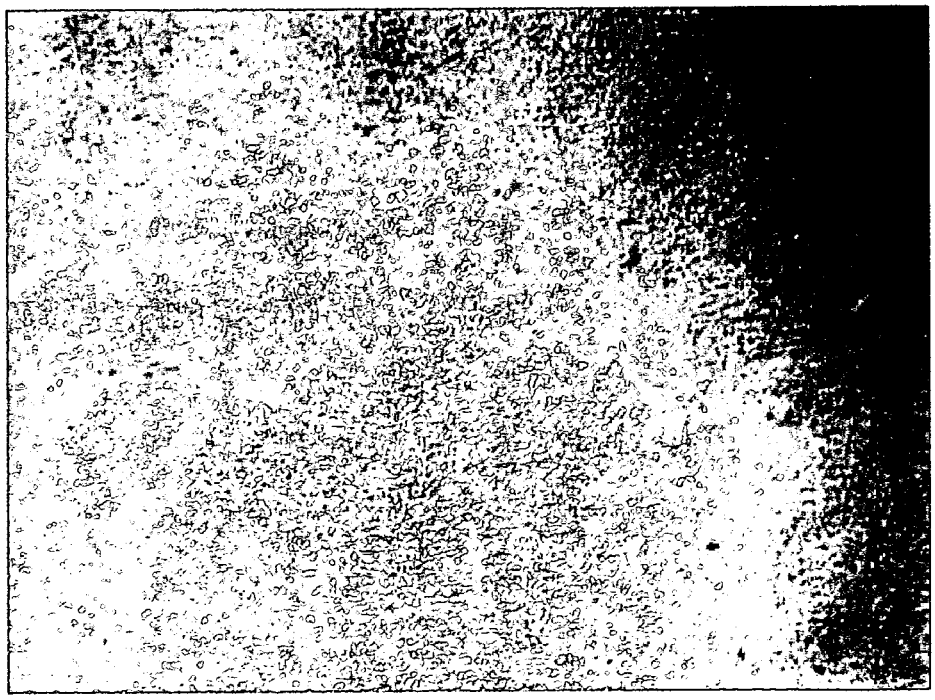

FIG. 20 is a 5× low angle illumination photomicrograph illustrating the surface of the outermost ply of tissue from a 2-ply tissue roll finished with one embodiment of the tail-sealing technology of the present invention. It can be observed that the bond area is more extensive, approximately 6-7 mm in width, and the appearance of the embossing pattern is far less degraded than with the technology employed in tissue roll illustrated in FIGS. 16-19. Similarly, in FIG. 21, it can be observed that the bond area is far more extensive than in FIGS. 16-19 but that, as the adhesive was in this case applied directly to this area, the appearance of the surface more closely approximates that of FIG. 19. In FIG. 22, it can again be observed that the bond area on the outer surface of the inner sheet is far more extensive than in conventional tail-sealing. Note however that these regions are concealed from the user prior to initiation of use. Similarly, in FIG. 23, it can be observed that adhesive is spread over a larger area but has barely affected the inner surface of the inner tissue sheet in the tail seal region.

Figure 24:
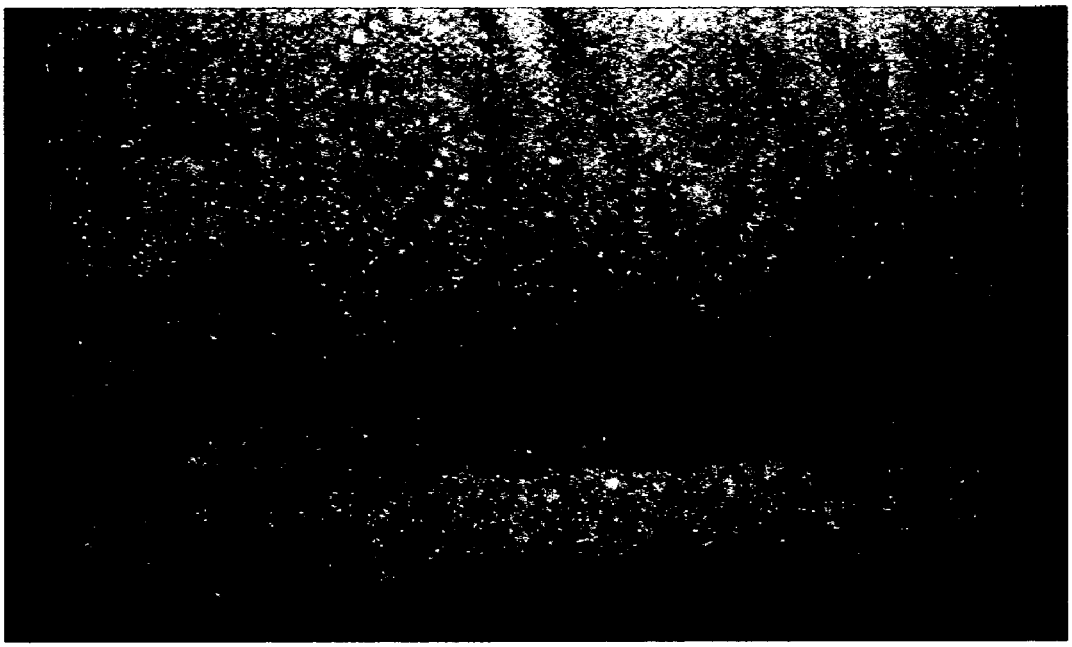
FIGS. 24 and 25 are low angle illumination photographs illustrating and comparing, respectively, a conventional tail-seal area and one embodiment of a tail seal of the present invention.
Figure 25:
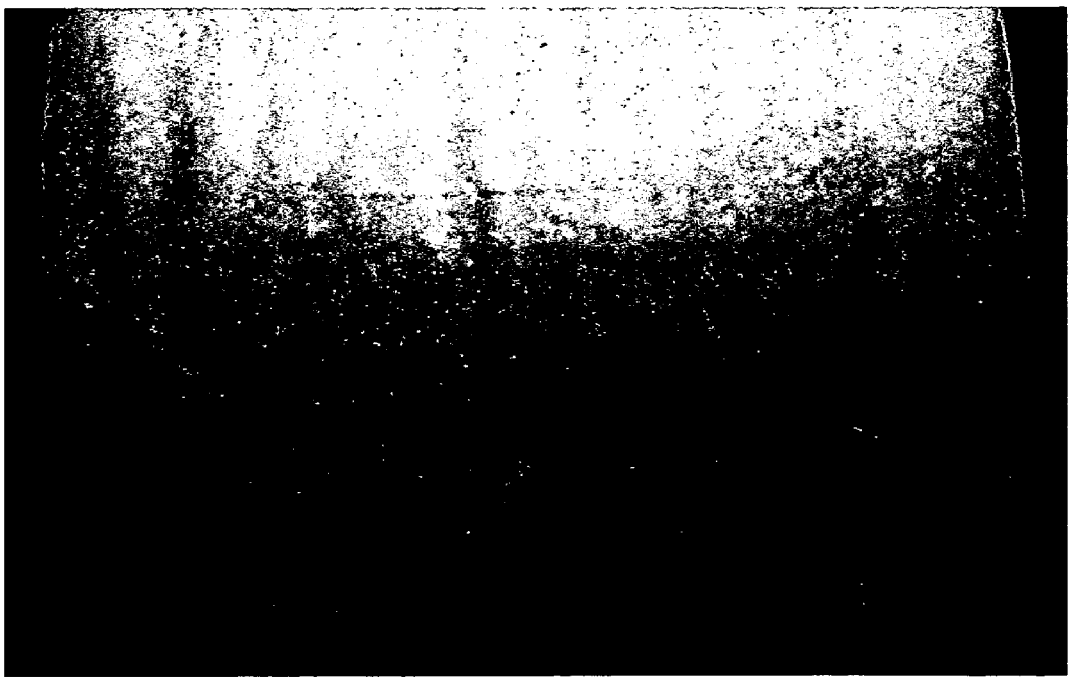
Figure 26:
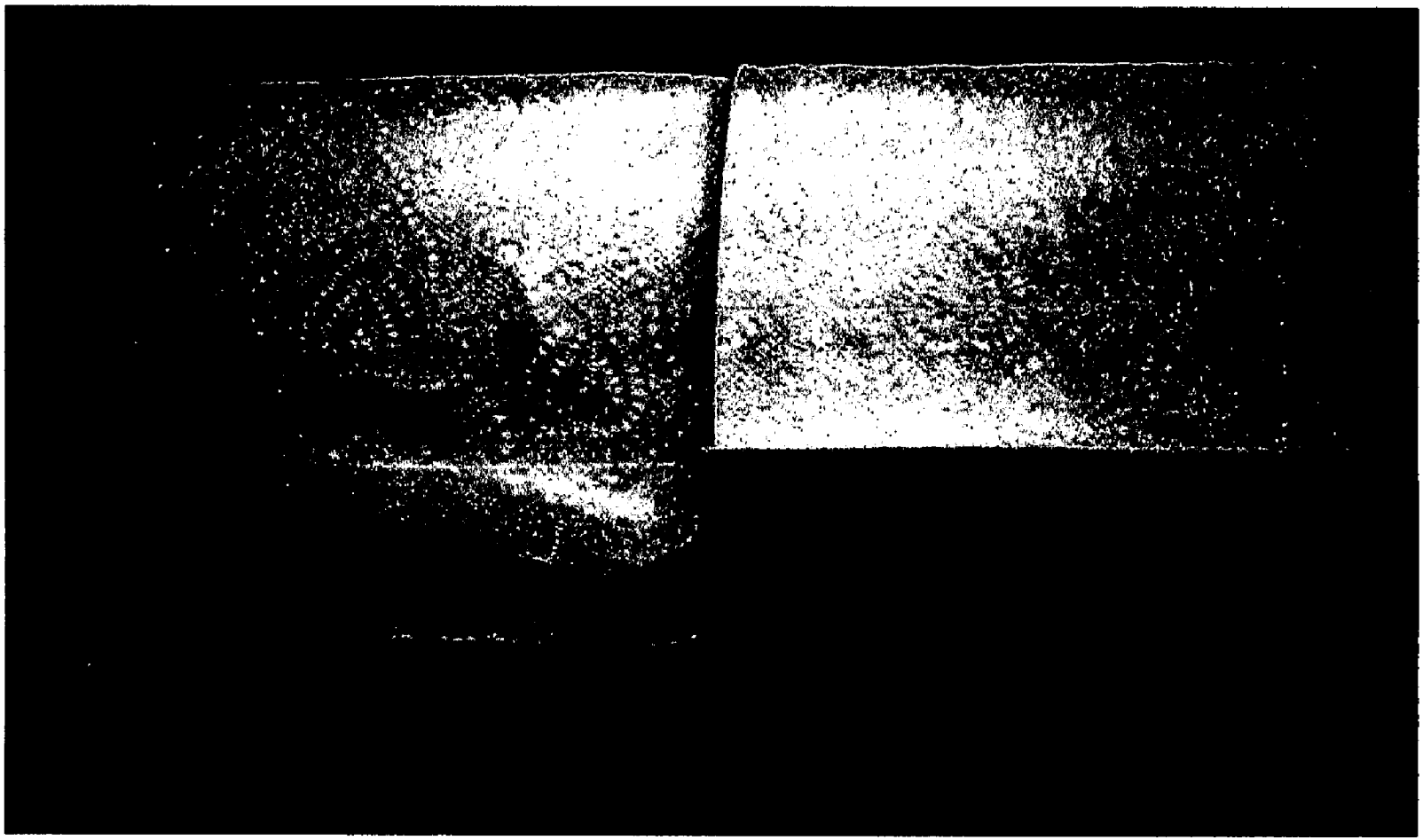
FIG. 26 illustrates another comparison between a ply-separated tail seal and a folded over tail seal tab of the present invention.

By comparing FIGS. 24 and 25, it can be appreciated that the folded over tail seal according to one embodiment of the present invention illustrated in FIG. 25 presents a far neater and more aesthetically pleasing appearance than that of the conventional tail seal illustrated in FIG. 24. However, a far more important point is illustrated in FIG. 26, as it can be clearly observed that the conventional roll shown on the left already exhibits ply separation while the roll prepared according to one embodiment of the present invention shown on the right presents a neat finished edge. Accordingly, it would be necessary for a user of the conventional roll to exercise some care to avoid ply separation upon initiation of use; but considerable effort would be required to induce ply-separation upon initiation of use in the roll prepared according to the present invention.

FIGS. 27 A-E illustrate schematically how a tail seal corresponding to that shown in the right hand roll of FIG. 26 may be formed on automated machinery. In FIG. 27 A, tail 61 is extended from log 54, then in FIG. 27 B, vacuum 96 is applied at vacuum location 97 spaced from free end 60 of tail 61 to retain medial portion 98 of tail 61 as free end 60 and distal portion 81 of tail 61 is folded upwardly and inwardly over medial portion 98 of tail. In FIG. 27 C, traversing glue gun 100 applies line of adhesive, glue line 80, at a location 102 spaced outwardly from the original free end 60 of doubled over tail 104 but inwardly from the new doubled over free end 106 of doubled over tail 104. It is greatly preferred that vacuum location 97 is chosen such that when free end 60 and proximal portion 81 of tail 61 are folded upwardly and inwardly over medial portion 98 of tissue sheet 70, the location of free end 60 is chosen such that it will not require that adhesive 76 be applied in a location where adhesive 76 may penetrate into proximity of perf lines 78, 82 or 85 on tissue log 54 when the tail sealing operation is completed. In FIG. 27 D, log 54 is rolled over line of adhesive 80 and doubled over free end 106 of tail 104 providing a preliminary seal. In FIG. 27 E, log 54 is rotated as it engages ironing roll 110 at a controlled pressure, pressing doubled over tail 104 against log 54 thereby urging adhesive 76 into log 54 to a depth of penetration which is controlled by modifying the dilution, area of application, pressure of application, amount applied and viscosity of adhesive 76.

Figure 28:
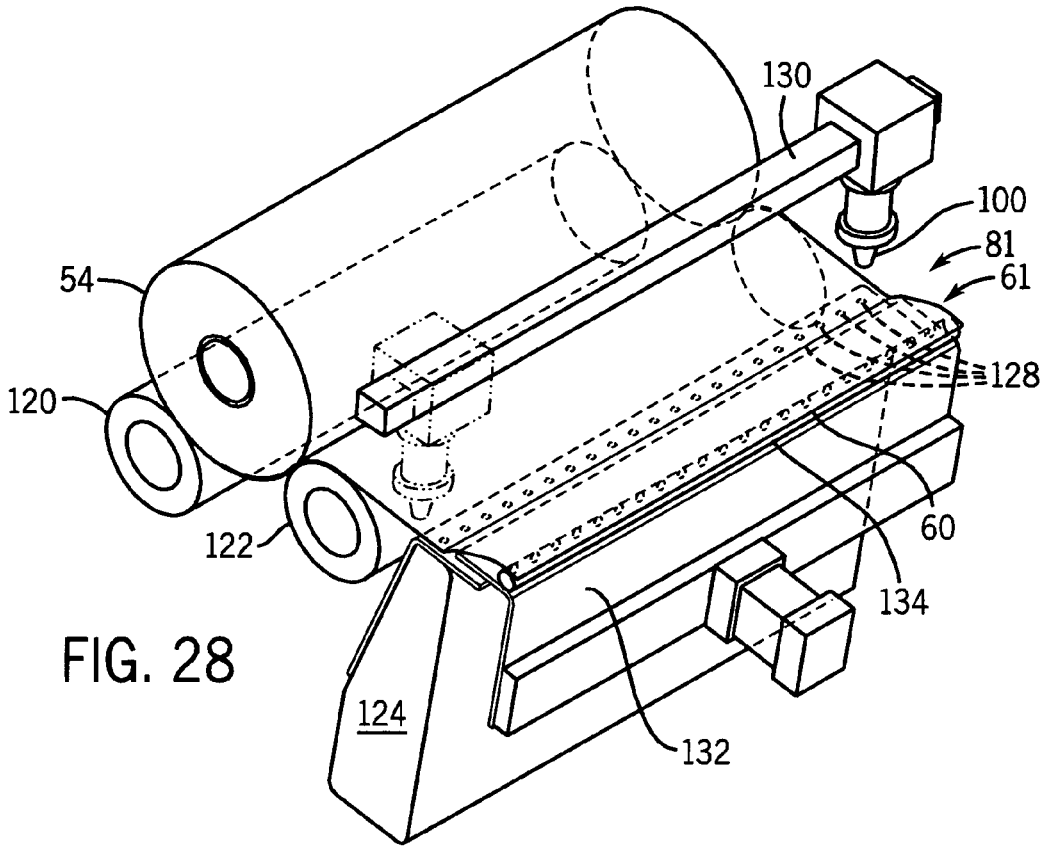
FIG. 28 is a schematic isometric perspective illustrating one embodiment of a device for forming a folded over tail-seal tab of the present invention wherein the folding arm is in the retracted position.
Figure 29:
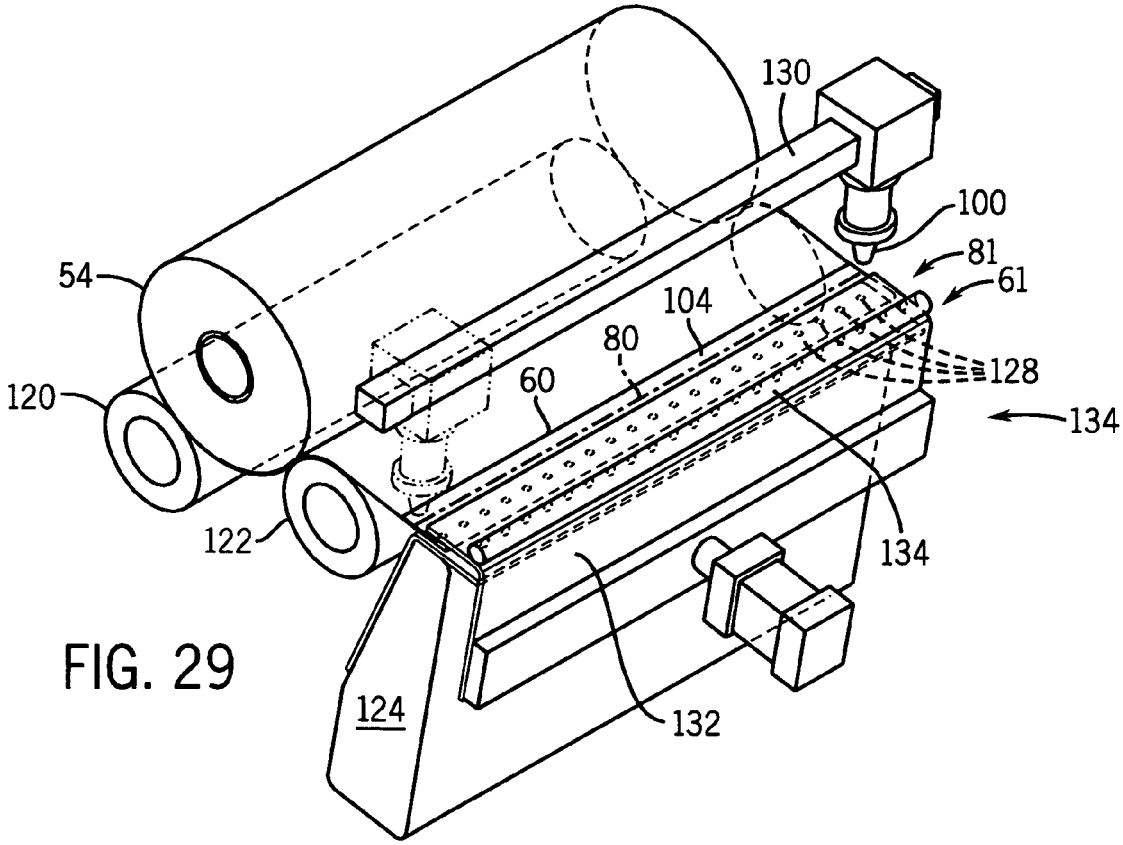
FIG. 29 is a schematic isometric perspective illustrating one embodiment of a device for forming a folded over tail-seal tab of the present invention wherein the folding arm is in the extended position

FIGS. 28 and 29 illustrate the specific mechanism used for carrying out the procedure described in FIGS. 27B and C. In particular, FIG. 28 illustrates log 54 resting on driven rollers 120 and 122. Free end 60 of tail 61 extends outwardly from log 54, overlies jet tube 130 on folding arm 132 and is retained on table 124 by vacuum applied through vacuum apertures 128. Air jets 134 mounted on reciprocating arm 132 blow free end 60 and distal portion 81 of tail 61 upwardly and inwardly toward log 54 while reciprocating arm 132 moves toward log 154 thereby forming fold 134 in tail 61. Traversing glue gun 100 mounted on rail 130 moves across folded tail 104 applying line of adhesive 80 to folded tail 104.

Figure 30:
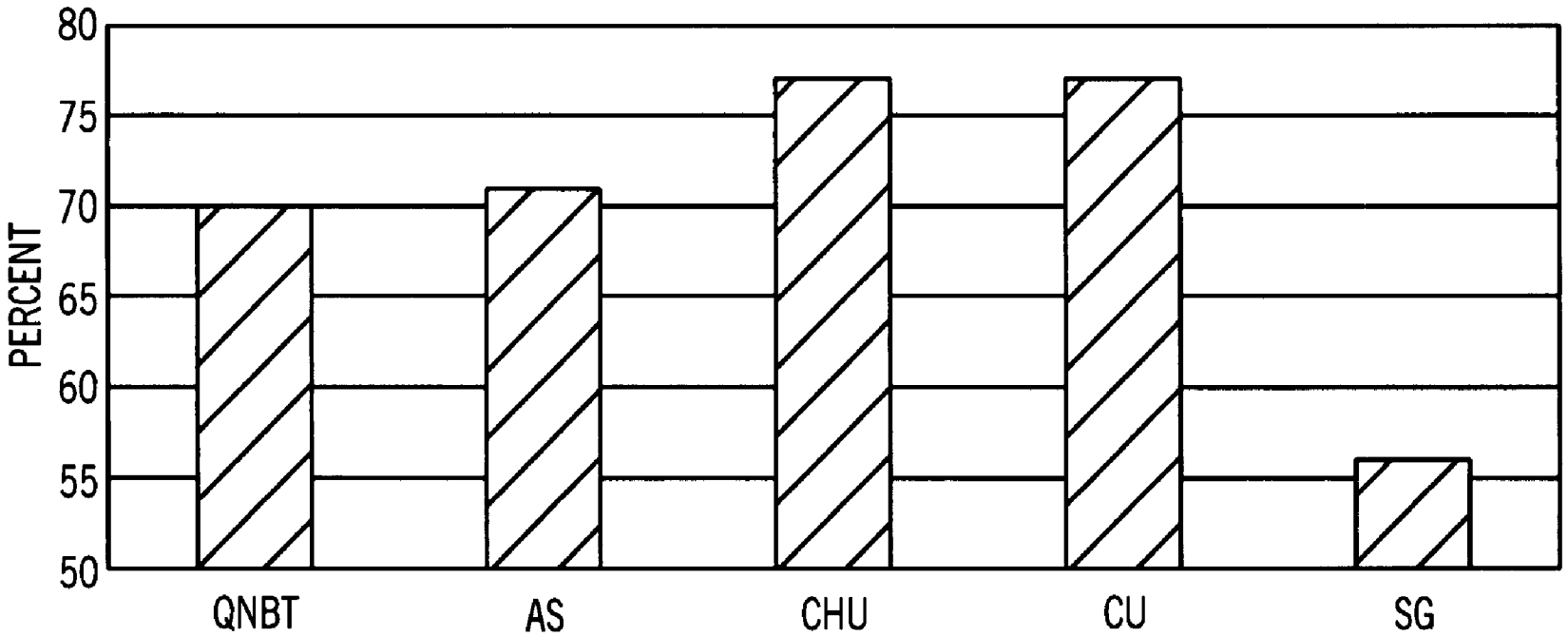
FIG. 30 is a bar chart illustrating the frequency of issues relating to ply separation.

FIG. 30 illustrates the frequency of occurrence of ply separation issues encountered in the major brands of 2-ply bathroom tissue currently on the market: Quilted Northern®; Angel Soft®; Charmin® Ultra; Cottonelle® Ultra; and, Soft 'N Gentle® bathroom tissues. This data was generated in market research studies using product taken from store shelves.

Figure 31:
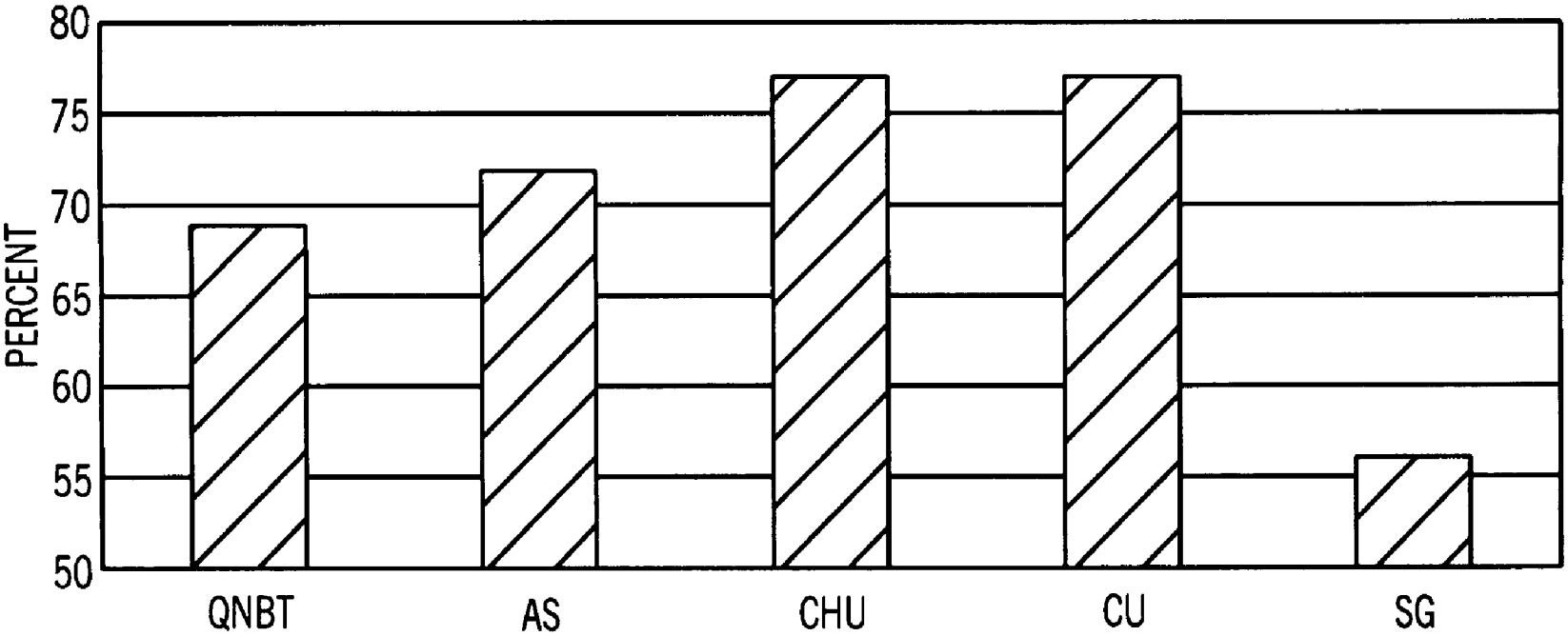
FIG. 31 is a bar chart illustrating the frequency of issues relating to ease of starting a roll.

FIG. 31 illustrates the frequency of occurrence of difficulties in starting roles of the major brands of 2-ply bath tissue on the market as reported by consumers of these products.

Figure 32:
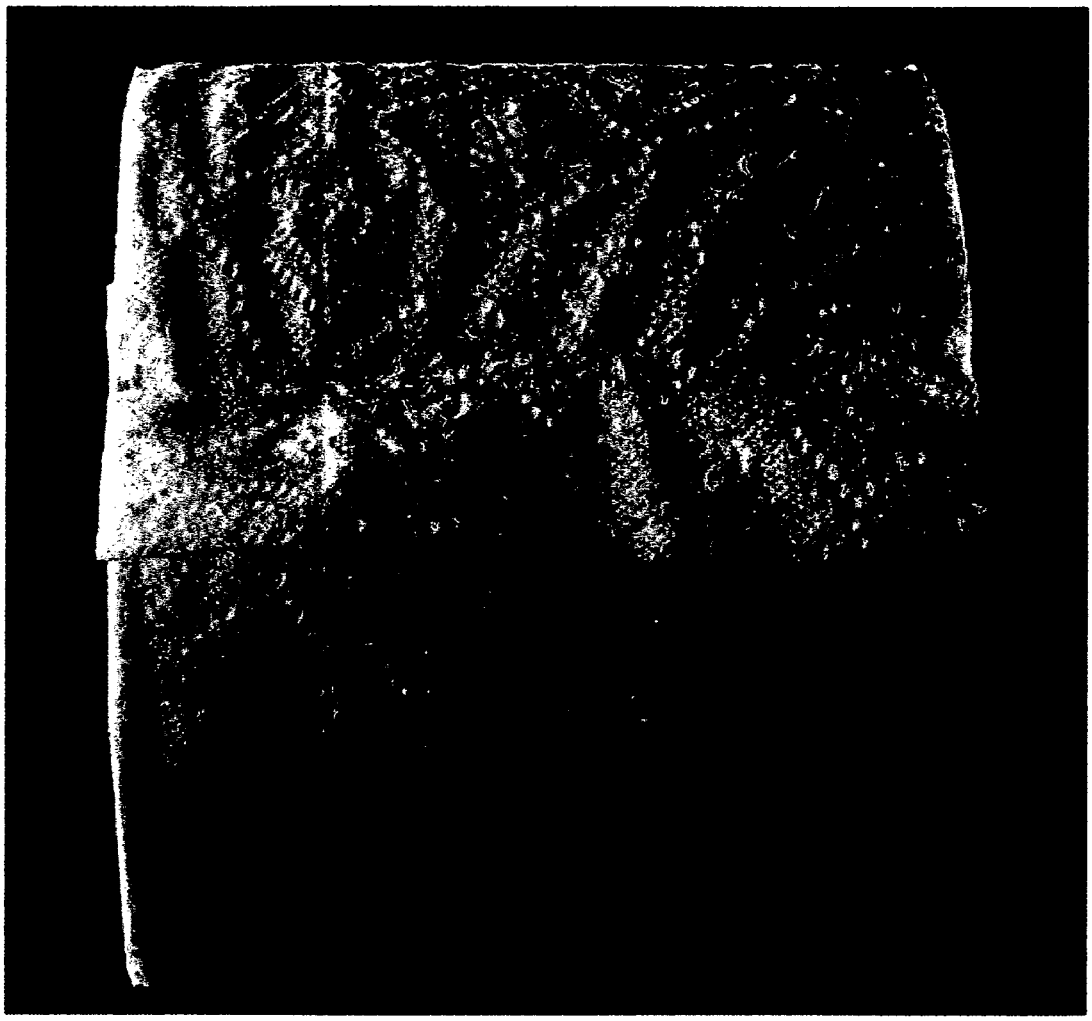
FIG. 32 is a photograph illustrating the distribution of adhesive over a wide band to limit the bond strength per unit area between the tail and the underlying surface.

FIG. 32 illustrates a well-sealed roll of bath tissue prepared according to one embodiment of the present invention.

Figure 33:
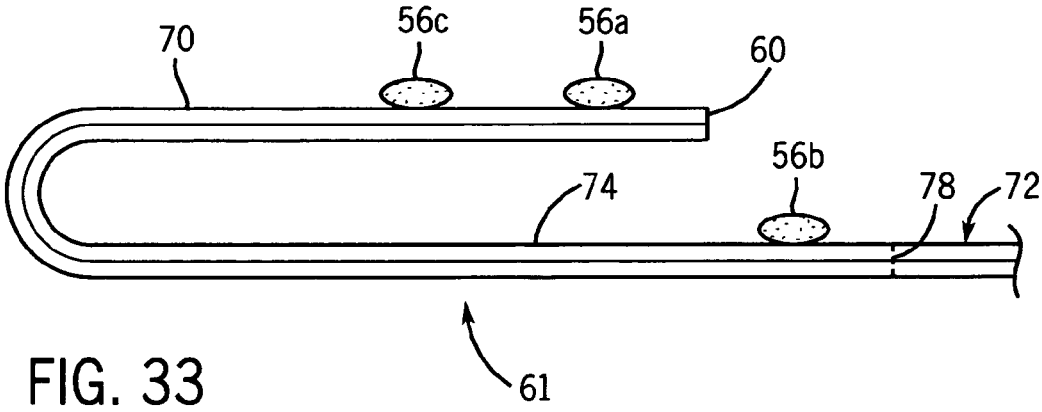
FIG. 33 is a schematic sectional view illustrating an embodiment in which three lines of adhesive are used to better control distribution and penetration of adhesive bonds.

In FIG. 33, we illustrate an alternative embodiment employing three glue lines 56*a*, 56*b*, 56*c*, formed by application of adhesive 76 to better control penetration of adhesive 76 and resultant distribution of the adhesive bonds in which primary glue line 56*a* on ply 64 is formed by applying adhesive 76 to distal portion 81 of initial sheet 70 closely adjacent free end 60 while secondary glue line 56*b* is formed on ply 62 by applying adhesive 76 at proximal portion 74 thereof adjacent free end 60 of initial sheet 70 and tertiary glue line 56*c* is formed on ply 64 by applying adhesive 76 to distal portion 81 of initial sheet 70 closely proximate to, but spaced from, primary glue line 56*a*. Note that secondary glue line 56*b* is spaced from perf line 78 joining initial sheet 70 and penultimate sheet 72. In many applications, it may be advantageous to control the amount of adhesive 76 used in formation of either primary glue line 56*a* or secondary glue line 56*b* such that upon respooling against body 52 of tissue log 54, the adhesive in either primary glue line 56*a* or secondary glue line 56*b* will overlap free end 60 of initial sheet 70. However this is not necessary to obtain tail seal which is greatly improved over that currently available commercially.

Figure 34:
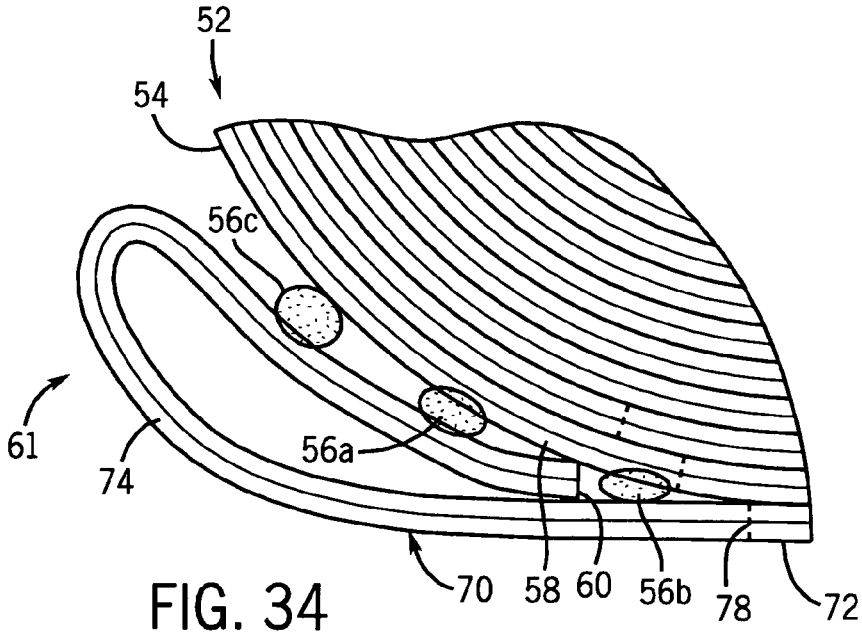
FIG. 34 is a schematic sectional view illustrating the free end of the tissue roll of FIG. 33 after it is spooled against the underlying sheets in the roll.

In FIG. 34, tissue tail 61 has been respooled against body 52 of tissue log 54 trapping free end 60 of initial sheet 70 between proximal portion 74 of initial sheet 70 of tissue tail 61 and next adjacent underlying tissue sheet 58 of tissue log 54. In the embodiment shown in FIG. 34, a relatively low spreading adhesive 76 is depicted whereupon neither primary glue line 56*a* nor secondary glue line 56*b* has spread to overlap free end 60 of initial sheet 70. Note also that secondary glue line 56*b* remains spaced both from perf line 78 adjoining tissue sheets 70 and 72 and perf line 82 between sheets 58 and 84 in the next adjacent underlying layer of tissue log 54.

Figure 35:
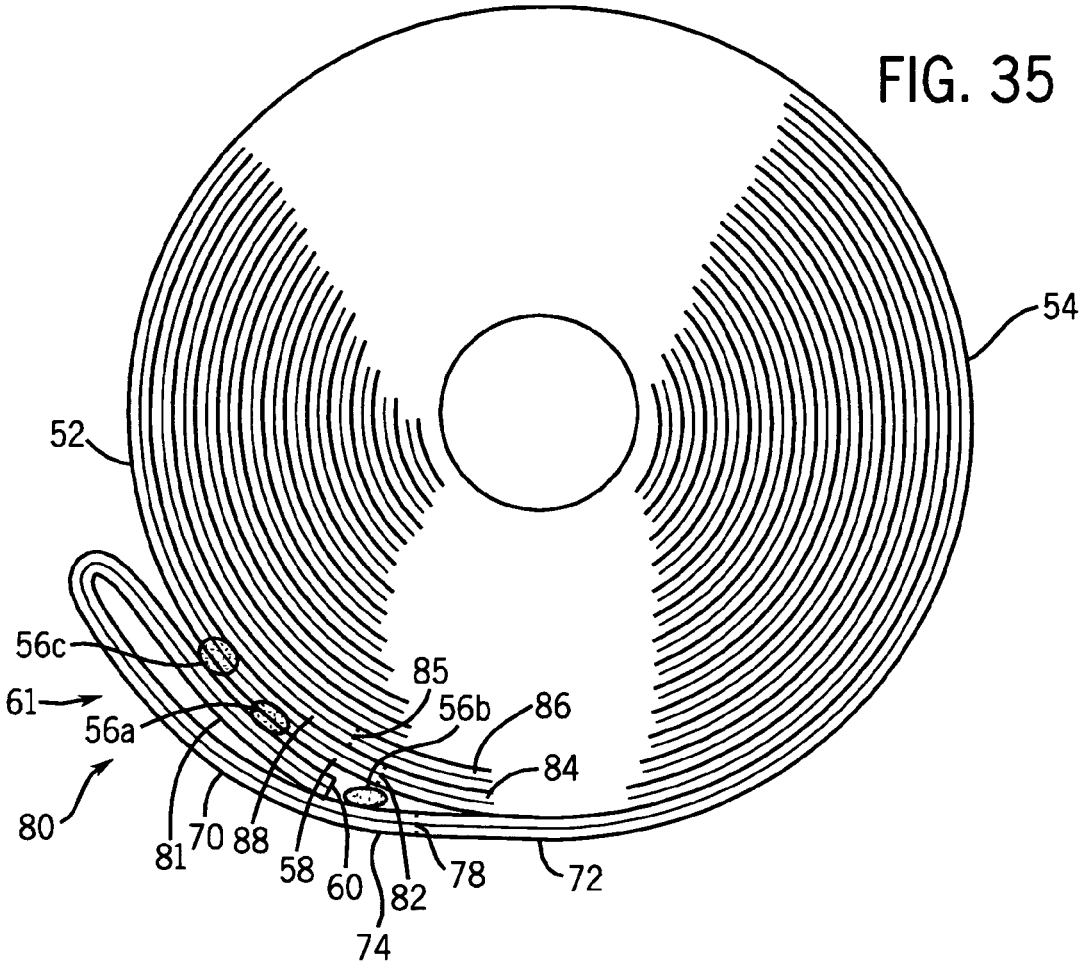
FIG. 35 is a schematic sectional view illustrating the free end of the tissue roll of FIG. 34 after pressing against the body of the roll.

In FIG. 35, free end 60 of initial sheet 70 of tissue tail 71 has been pressed against body 52 of tissue log 54 so that secondary glue line 56*b* remains spaced from perf lines 78 joining tissue sheet 70 and 72 while primary glue line 56*a* remains spaced from both perf line 72 and perf line 82 between tissue sheets 58 and 84 next adjacent underlying layer of tissue in log 54.

Figure 36:
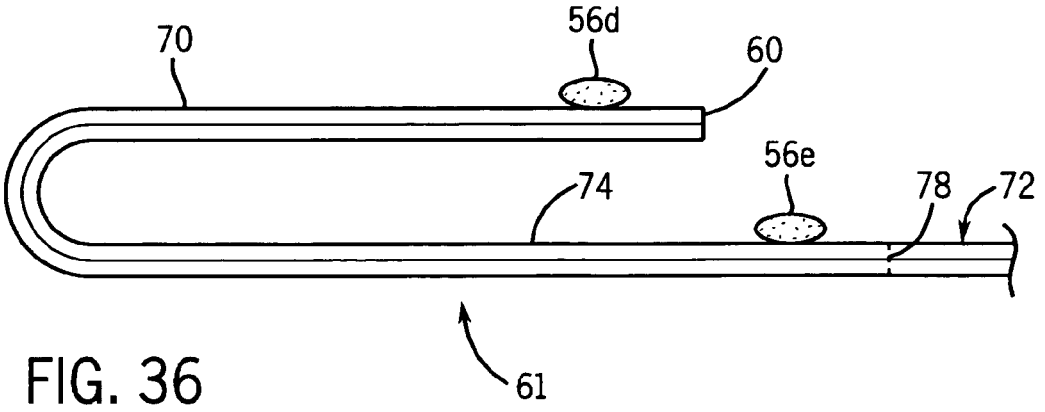
FIG. 36 is a schematic sectional view illustrating an embodiment in which to lines of adhesive are used to better control distribution and penetration of adhesive bonds.

Similarly, in FIG. 36, adhesive 76 has been applied to ply 64 of distal portion 81 of initial tissue sheet 70 closely adjacent free end 62 to form glue line 56*d* while glue line 56*e* has been formed by application of adhesive 76 to ply 64 of proximal portion 74 of initial tissue sheet 70. In FIG. 37, folded over tail-tab 50 has been respooled against body 52 of tissue log 54; and, in FIG. 38, folded over tail-tab 50 has been pressed against body 52 of tissue log 54. Note that glue lines 56*e* and 56*d* remain well spaced from all perf lines. In these FIGS. 33-38, we have not attempted to precisely portray the penetration of adhesive through the various plies but rather the initial placement of the glue lines.

Adhesives suitable for use in the practice of the present invention are well known and are available from a wide variety of sources including H. B. Fuller and others. One suitable adhesive is sold under the trade name "WB 4955 MD". We prefer to use this as a 5.5% solids admixture having a viscosity of approximately 1600 cps at 85° Fahrenheit. The total amount of adhesive that we apply for each approximately 4½ inch roll of bath tissue is approximately 0.35 ml to attain an average tail seal strength of 97 g. We use a Paasche pneumatic adhesive gun with a single bead 0.74" orifice operating at 30 psi spaced approximately 1 in. from the web. Use of these parameters with substrates normally used for premium grade commercial bath tissue sold under the trade names Quilted Northern® bath tissue, Quilted Northern® Ultra bath tissue, and Angel Soft® bath tissue, produces excellent results when applied to the locations specified. However, far more important than the exact chemical composition of the adhesive is the control of penetration into the roll by controlling the amount of adhesive applied, its dilution, the amount of pressure applied by the ironing roll, the amount of vacuum applied in the vicinity of the line of application of the adhesive, and precise control of the area over which the adhesive is applied. These matters can best be controlled empirically by adjustments during the manufacturing process by closely observing the structure of the resulting tail seal. It is very advantageous: to prevent any of the bonds formed by the adhesive from being located in close proximity to perf lines in the layers of tissue bonded to one another; as well as to ensure that the tissue sheets are not bonded in such a fashion as to promote separation as might occur should the outer ply of the inner layer be firmly bonded to the inner ply of the next exteriorly adjacent layer but the inner ply of the inner layer not be bonded thereby to the outer ply of the inner layer. The practice of the present invention is also well suited to operations in which the direction of rotation of the log 54 is never reversed making this tail seal procedure particularly well-suited for high-speed manufacturing operations as well as to tail-sealers which do reverse roll direction.

For those applications where it is desired to employ multiple glue lines, the adhesive viscosity may be reduced to the range of about 100-200 cps at 85° F. using an adhesive solids in the range of 2% to 3% extruded from a Spraymation electric extrusion head having 2 or 3 orifices 0.025 in. in diameter to achieve a total add on of about 0.35 ml or less targeting an average tail seal strength of about 80 g.

As our invention, we claim:

1. A roll of tissue product comprising a plurality of sheets of tissue, each sheet separated from the others by lines of perforation, wherein:

a. the tail of the roll of tissue product has a distal portion spaced away from the remainder of the roll, a proximal portion adjoining the remainder of the roll and a medial portion in-between;

b. the distal portion of the tail being transversely folded, thereby forming a transverse fold and a folded tail tab extending across the tail;

c. an adhesive bond extending over an area overlapping the distal edge of the tail adhering the distal and proximal portions of the tail to the next interior sheet of tissue inwardly adjacent thereto;

d. said adhesive bond penetrating through both the distal portion of the tail and the proximal portion of the tail;

e. the area over which said adhesive bond extends neither spanning nor adjoining a line of perforation joining sheets in the initial four sheets of the roll of tissue product; and f. the medial portion of the tail comprises the folded tail tab, the folded tail tab having a dry tensile strength of at least 1½ times the strength of the adhesive bond adhering the distal and proximal portions of the tail to the next interior sheet of tissue inwardly adjacent thereto.

2. The roll of tissue product of claim 1, wherein the area over which said adhesive bond extends is spaced from the medial portion of the tail of the roll such that the folded tail tab presented to the user is a projecting folded tail tab.

3. The roll of tissue product of claim 2, wherein the dry tensile strength of the projecting folded over tail tab exceeds 400 g/in and the caliper thereof exceeds one mil.

4. The roll of tissue product of claim 2, wherein the dry tensile strength of the projecting folded over tail tab exceeds 500 g/in and the caliper thereof exceeds two mils.

5. The roll of tissue product of claim 1, wherein said tissue product is a multi-ply tissue product and said adhesive bond penetrates inwardly through the exterior ply of the multi-ply tissue sheet underlying the tissue sheet inwardly adjacent to said adhesive bond and forms an interior subsidiary bond adhering the exterior ply of the multi-ply tissue sheet underlying the tissue sheet inwardly adjacent to said adhesive bond to the interior ply of the multi-ply tissue sheet underlying the tissue sheet inwardly adjacent to said adhesive bond.

6. The roll of multi-ply tissue product of claim 5, wherein the medial portion of the tail comprising the folded tail tab projects from the roll body by from at least about ¼" up to about 2¼".

7. The roll of multi-ply tissue product of claim 5, wherein said adhesive bond penetrates inwardly through the exterior ply of a multi-ply tissue sheet underlying the tissue sheet inwardly adjacent to said adhesive bond and forms an interior subsidiary bond adhering the exterior ply of that multi-ply tissue sheet to the interior ply of the multi-ply tissue sheet thereof.

8. The roll of tissue product of claim 1, wherein the medial portion of the tail comprising the folded tail tab, the folded tail tab having a dry tensile strength of at least 1¼ times the sum of the machine direction dry tensile strength of the tissue product and the strength of the adhesive bond adhering the distal and proximal portions of the tail to the next interior sheet of tissue inwardly adjacent thereto.

9. The roll of tissue product of claim 1, wherein the medial portion of the tail comprises the folded tail tab, the folded tail tab having a dry tensile strength of at least twice the strength of the adhesive bond adhering the distal and proximal portions of the tail to the next interior sheet of tissue inwardly adjacent thereto.

10. The roll of tissue product of claim 1, wherein the strength of the adhesive bond adhering the distal and proximal portions of the tail to the next interior sheet of tissue inwardly adjacent thereto is no more than about 75% of the machine direction dry tensile strength of the tissue product.

11. The roll of tissue product of claim 1, wherein the area of said adhesive bond is approximately the width of the roll and extends from about ⅛" to about ½" in the machine direction.

12. The roll of tissue product of claim 1, wherein said tissue product is a multi-ply tissue and each adhesive bond adhering the exterior ply of a multi-ply tissue sheet underlying a tissue sheet inwardly adjacent to said adhesive bond to the interior ply of a tissue sheet outwardly adjacent thereto also adheres the exterior ply of the multi-ply tissue sheet underlying that tissue sheet to the interior ply of the multi-ply tissue sheet underlying that tissue.

13. The roll of tissue product of claim 1, wherein said tissue product is a multi-ply tissue and each adhesive bond adhering the exterior ply of a multi-ply tissue sheet underlying a tissue sheet inwardly adjacent to said adhesive bond to the interior ply of a tissue sheet outwardly adjacent thereto neither spans nor adjoins a line of perforation joining sheets in the initial six sheets of the roll of multi-ply tissue product.

14. The roll of tissue product of claim 1, wherein said tissue product is a multi-ply tissue and each adhesive bond adhering the exterior ply of a multi-ply tissue sheet underlying a tissue sheet inwardly adjacent to said adhesive bond to the interior ply of a tissue sheet outwardly adjacent thereto neither spans nor adjoins a line of perforation joining sheets in the initial eight sheets of the roll of multi-ply tissue product.

15. The roll of tissue product of claim 1, wherein the strength of the adhesive bond extending over an area spaced from the distal edge of the initial sheet adhering the distal and proximal portions of the tail to the next interior sheet of tissue inwardly adjacent thereto is at least about 50 g/3" but no more than about 300 g/3".

16. The roll of tissue product of claim 1, wherein the strength of the adhesive bond extending over an area spaced from the distal edge of the tail adhering the distal and proximal portions of the tail to the next interior sheet of tissue inwardly adjacent thereto is at least about 60 g/3" but no more than about 200 g/3".

17. The roll of tissue product of claim 1, wherein the strength of the adhesive bond extending over an area spaced from the distal edge of the tail and adhering the distal and proximal portions of the tail to the next interior sheet of tissue inwardly adjacent thereto is at least about 60 g/3" but no more than about 150 g/3".

18. The roll of tissue product of claim 1, wherein the strength of the adhesive bond extending over an area spaced from the distal edge of the tail and adhering the distal and proximal portions of the tail to the next interior sheet of tissue inwardly adjacent thereto is at least about 60 g/3" but no more than about 120 g/3".

19. The roll of tissue product of claim 1, wherein the strength of the adhesive bond extending over an area spaced from the distal edge of the tail and adhering the distal and proximal portions of the tail to the next interior sheet of tissue inwardly adjacent thereto is at least about 70 g/3" but no more than about 110 g/3".

20. A roll of tissue product comprising a plurality of sheets of tissue, each sheet separated from the others by lines of perforation, wherein:

a. the tail of the roll of tissue product has a distal portion spaced away from the remainder of the roll, a proximal portion adjoining the remainder of the roll and a medial portion in-between;

b. the distal portion of the tail being transversely folded over thereby forming a transverse fold and a folded tail seal tab extending across the tail;

c. an adhesive bond extends over an area spaced from the distal edge of the tail adhering the distal and proximal portions of the tail to the next interior sheet of tissue inwardly adjacent thereto;

d. said adhesive bond penetrates through the distal portion of the folded tail and the proximal portion of the tail;

e. the area over which said adhesive bond extends neither spans nor adjoins a line of perforation joining sheets in the initial four sheets of the roll of tissue product; and f. the medial portion of the tail comprising the folded tail seal tab, the folded tail seal tab having a dry tensile strength of at least 1½ times the strength of the adhesive bond adhering the distal and proximal portions of the tail to the next interior sheet of tissue inwardly adjacent thereto.

21. The roll of tissue product of claim 20, wherein the area over which said adhesive bond extends is spaced from the medial portion of the tail of the roll such that the folded tail seal tab presented to the user is a projecting folded tail seal tab.

22. The roll of tissue product of claim 21, wherein the dry tensile strength of the projecting folded tail seal tab exceeds 400 g/in and the caliper thereof exceeds one mil.

23. The roll of tissue product of claim 20, wherein the dry tensile strength of the projecting folded tail seal tab exceeds 500 g/in and the caliper thereof exceeds two mils.

24. The roll of tissue product of claim 20, wherein said tissue product is a multi-ply tissue and adhesive penetrates inwardly through the exterior ply of the multi-ply tissue sheet underlying the tissue sheet inwardly adjacent to said adhesive bond and forms an interior subsidiary bond adhering the exterior ply of the multi-ply tissue sheet underlying the tissue sheet inwardly adjacent to said adhesive bond to the interior ply of the multi-ply tissue sheet underlying the tissue sheet inwardly adjacent to said adhesive bond.

25. The roll of multi-ply tissue product of claim 24, wherein the strength of the adhesive bond extending over an area spaced from the distal edge of the tail adhering the distal portion of the folded exterior ply to the exterior ply of the next interior sheet of multi-ply tissue inwardly adjacent thereto is at least about 50 g/3" but no more than about 300 g/3", while the strength of the interior subsidiary bond is no more than about 40 g/3".

26. The roll of multi-ply tissue product of claim 25, wherein said adhesive penetrates inwardly through the exterior ply of a multi-ply tissue sheet underlying the tissue sheet inwardly adjacent to said adhesive bond and forms an interior subsidiary bond adhering the exterior ply of that multi-ply tissue sheet to the interior ply of the multi-ply tissue sheet thereof.

27. The roll of multi-ply tissue product of claim 24, wherein said tissue product is a multi-ply tissue and wherein each adhesive bond adhering the exterior ply of a multi-ply tissue sheet underlying a tissue sheet inwardly adjacent to said adhesive bond to the interior ply of a tissue sheet outwardly adjacent thereto also adheres the exterior ply of the multi-ply tissue sheet underlying that tissue sheet to the interior ply of the multi-ply tissue sheet underlying that tissue.

28. The roll of tissue product of claim 20, wherein each adhesive bond adhering a tissue sheet underlying a tissue sheet inwardly adjacent to said adhesive bond to the sheet outwardly adjacent thereto neither spans nor adjoins a line of perforation joining sheets in the initial six sheets of the roll of tissue product.

29. The roll of tissue product of claim 20, wherein each adhesive bond adhering a tissue sheet underlying a tissue sheet inwardly adjacent to said adhesive bond to the interior ply of a tissue sheet outwardly adjacent thereto neither spans nor adjoins a line of perforation joining sheets in the initial eight sheets of the roll of tissue product.

30. The roll of tissue product of claim 20, wherein the strength of the adhesive bond extending over an area spaced from the distal edge of the tail and adhering the distal and proximal portions of the tail to the next interior sheet of tissue inwardly adjacent thereto is at least about 50 g/3" but no more than about 300 g/3".

31. The roll of tissue product of claim 20, wherein the strength of the adhesive bond extending over an area spaced from the distal edge of tail and adhering the distal and proximal portions of the tail to the next interior sheet of tissue inwardly adjacent thereto is at least about 60 g/3" but no more than about 200 g/3".

32. The roll of tissue product of claim 20, wherein the strength of the adhesive bond extending over an area spaced from the distal edge of the tail and adhering the distal and proximal portions of the tail to the next interior sheet of tissue inwardly adjacent thereto is at least about 60 g/3" but no more than about 150 g/3".

33. The roll of tissue product of claim 20, wherein the strength of the adhesive bond extending over an area spaced from the distal edge of the tail and adhering the distal and proximal portions of the tail to the next interior sheet of tissue inwardly adjacent thereto is at least about 60 g/3" but no more than about 120 g/3".

34. The roll of tissue product of claim 20, wherein the strength of the adhesive bond extending over an area spaced from the distal edge of the tail adhering the distal and proximal portions of the tail to the next interior sheet of tissue inwardly adjacent thereto is at least about 70 g/3" but no more than about 110 g/3".

35. The roll of tissue product of claim 20, wherein the medial portion of the tail comprises the folded tail seal tab, the folded tail seal tab projecting from the roll body by from at least about ¼" up to about 2¼".

36. The roll of tissue product of claim 35, wherein said tissue product is a multi-ply tissue and wherein adhesive penetrates inwardly through the exterior ply of a multi-ply tissue sheet underlying the tissue sheet inwardly adjacent to said adhesive bond and forms an interior subsidiary bond adhering the exterior ply of that multi-ply tissue sheet to the interior ply of the multi-ply tissue sheet thereof.

37. The roll of tissue product of claim 20, wherein the medial portion of the tail comprises the folded tail seal tab, the folded tail seal tab having a dry tensile strength of at least 1¼ times the sum of the machine direction dry tensile strength of the tissue product and the strength of the adhesive bond adhering the distal and proximal portions of the folded tail to the next interior sheet of tissue inwardly adjacent thereto.

38. The roll of tissue product of claim 20, wherein the medial portion of the tail comprises the folded tail seal tab, the folded tail seal tab having a dry tensile strength of at least twice the strength of the adhesive bond adhering the distal and proximal portions of the tail to the next interior sheet of tissue inwardly adjacent thereto.

39. The roll of tissue product of claim 20, wherein the strength of the adhesive bond adhering the distal and proximal portions of the tail to the next interior sheet of tissue inwardly adjacent thereto is no more than about 75% of the machine direction dry tensile strength of the tissue product.

40. The roll of tissue product of claim 20, wherein the area of said adhesive bond is approximately the width of the roll and extends from about ⅛" to about ½" in the machine direction.

41. A roll of tissue product comprising a plurality of sheets of tissue, each sheet separated from the others by lines of perforation, the tail of the roll of tissue product having:

a. a distal portion spaced away from the remainder of the roll;

b. a proximal portion adjoining the remainder of the roll; and c. a medial portion in-between;

d. the distal portion of the tail being transversely folded, thereby forming a transverse fold and a folded tail tab extending across the tail, said distal portion of the tail having a primary adhesive bond;

i) extending over an area overlapping the distal edge of the tail;

ii) adhering the distal and proximal portions of the tail to the next interior sheet of tissue inwardly adjacent thereto;

the area over which said primary adhesive bond extends neither spanning nor adjoining a line of perforation joining sheets in the initial four sheets of the roll of tissue product, said folded tail tab projecting from said roll and having a length of between ¼" and 2¼", and the medial portion of the tail comprises the folded tail tab, the folded tail tab having a dry tensile strength of at least 1½ times the strength of the adhesive bond adhering the distal and proximal portions of the tail to the next interior sheet of tissue inwardly adjacent thereto.

42. The roll of tissue product of claim 41, wherein said tissue product is a multi-ply tissue and wherein said adhesive bond also penetrates inwardly through the exterior ply of a multi-ply tissue sheet underlying the tissue sheet inwardly adjacent to said primary adhesive bond and forms an interior subsidiary bond adhering the exterior ply of that multi-ply tissue sheet to the interior ply of the multi-ply tissue sheet thereof.

43. The roll of tissue product of claim 41, wherein the medial portion of the tail comprises the folded tail tab, the folded tail tab having a dry tensile strength of at least 1¼ times the sum of the machine direction dry tensile strength of the tissue product and the strength of the primary adhesive bond adhering the distal and proximal portions of the tail to the next interior sheet of tissue inwardly adjacent thereto.

44. The roll of tissue product of claim 41, wherein the medial portion of the tail comprises the folded tail tab, the folded tail tab having a dry tensile strength of at least twice the strength of the primary adhesive bond adhering the distal and proximal portions of the tail to the next interior sheet of tissue inwardly adjacent thereto.

45. The roll of tissue product of claim 41, wherein the strength of the primary adhesive bond adhering the distal and proximal portions of the tail to the exterior ply of the next interior sheet tissue inwardly adjacent thereto is no more than about 75% of the machine direction dry tensile strength of the tissue product.

46. The roll of tissue product of claim 41, wherein the area of said primary adhesive bond is approximately the width of the roll and extends from about ⅛" to about ½" in the machine direction.

47. The roll of tissue product of claim 41, wherein the dry tensile strength of the projecting folded over tail exceeds 500 g/in and the caliper thereof exceeds two mils.

48. A roll of tissue product comprising a plurality of sheets of tissue, each sheet separated from the others by lines of perforation, the tail of the roll of tissue product having:

a. a distal portion spaced away from the remainder of the roll;

b. a proximal portion adjoining the remainder of the roll; and c. a medial portion in between;

the distal portion of the tail being transversely folded, thereby forming a transverse fold and a folded tail tab extending across the tail, said distal portion of the tail having an adhesive bond;

i) extending over an area adjacent the distal edge of the tail;

ii) adhering the distal and proximal portions of the tail to the next interior sheet of tissue inwardly adjacent thereto;

the dry tensile strength of the projecting folded over tail tab exceeding 400 g/in and the caliper thereof exceeding one mil;

the area over which said adhesive bond extends neither spanning nor adjoining a line of perforation joining sheets in the initial four sheets of the roll of tissue product and the medial portion of the tail comprises the folded tail tab, the folded tail tab having a dry tensile strength of at least 1½ times the strength of the adhesive bond adhering the distal and proximal portions of the tail to the next interior sheet of tissue inwardly adjacent thereto.

49. The roll of tissue product of claim 48, wherein the area of said adhesive bond is approximately the width of the roll and extends from about ⅛" to about ½" in the machine direction.

50. The roll of tissue product of claim 48, wherein the medial portion of the initial sheet comprises the folded tail tab, the folded tail tab having a dry tensile strength of at least 1¼ times the sum of the machine direction dry tensile strength of the tissue product and the strength of the adhesive bond adhering the distal and proximal portions of the folded exterior ply to the next interior sheet of tissue inwardly adjacent thereto.

51. The roll of tissue product of claim 48, wherein the medial portion of the initial sheet comprises the folded tail tab, the folded tail tab having a dry tensile strength of at least twice the strength of the adhesive bond adhering the distal and proximal portions of the tail to the next interior sheet of tissue inwardly adjacent thereto.

52. The roll of tissue product of claim 48, wherein the strength of the adhesive bond adhering the distal and proximal portions of the tail to the next interior sheet of tissue inwardly adjacent thereto is no more than about 75% of the machine direction dry tensile strength of the tissue product.

53. The roll of tissue product of claim 48, wherein the dry tensile strength of the projecting folded over tail tab exceeds 500 g/in and the caliper thereof exceeds two mils.

54. A roll of tissue product comprising a plurality of sheets of tissue, each sheet separated from the others by lines of perforation, the tail of the roll of tissue product having:

a. a distal portion spaced away from the remainder of the roll;

b. a proximal portion adjoining the remainder of the roll; and c. a medial portion in-between;

the distal portion of the initial sheet being transversely folded, thereby forming a transverse fold and a folded tail tab extending across the tail, said distal portion of the initial sheet having an adhesive bond;

i) extending over an area overlapping the distal edge of the tail;

ii) adhering the distal and proximal portions of the tail to the next interior sheet of tissue inwardly adjacent thereto;

iii) the strength of the adhesive bond being at least about 50 g/3" but no more than about 300 g/3";

the area over which said adhesive bond extends neither spanning nor adjoining a line of perforation joining sheets in the initial four sheets of the roll of tissue product and the medial portion of the tail comprises the folded tail tab, the folded tail tab having a dry tensile strength of at least 1½ times the strength of the adhesive bond adhering the distal and proximal portions of the tail to the next interior sheet of tissue inwardly adjacent thereto.

55. The roll of tissue product of claim 54, wherein the strength of the adhesive bond extending over an area spaced from the distal edge of the tail and adhering the distal and proximal portions of the tail to the next interior sheet of tissue inwardly adjacent thereto is at least about 60 g/3" but no more than about 200 g/3".

56. The roll of tissue product of claim 54, wherein the strength of the adhesive bond extending over an area spaced from the distal edge of the tail and adhering the distal and proximal portions of the tail to the next interior sheet of tissue inwardly adjacent thereto is at least about 60 g/3" but no more than about 150 g/3".

57. The roll of tissue product of claim 54, wherein the strength of the adhesive bond extending over an area spaced from the distal edge of the tail and adhering the distal and proximal portions of the tail to the next interior sheet of tissue inwardly adjacent thereto is at least about 60 g/3" but no more than about 120 g/3".

58. The roll of tissue product of claim 54, wherein the strength of the adhesive bond extending over an area spaced from the distal edge of the tail and adhering the distal and proximal portions of the tail to the next interior sheet of tissue inwardly adjacent thereto is at least about 70 g/3" but no more than about 110 g/3".

59. The roll of tissue product of claim 54, wherein the medial portion of the tail comprises the folded tail tab, the folded tail tab having a dry tensile strength of at least 1¼ times the sum of the machine direction dry tensile strength of the tissue product and the strength of the adhesive bond adhering the distal and proximal portions of the tail to the next interior sheet of tissue inwardly adjacent thereto.

60. The roll of tissue product of claim 54, wherein the medial portion of the tail comprising the folded tail tab, the folded tail tab having a dry tensile strength of at least twice the strength of the adhesive bond adhering the distal and proximal portion of the tail to the next interior sheet of tissue inwardly adjacent thereto.

61. The roll of tissue product of claim 54, wherein the strength of the adhesive bond adhering the distal portion of the tail to the next interior sheet of tissue inwardly adjacent thereto is no more than about 75% of the machine direction dry tensile strength of the tissue product.

62. The roll of tissue product of claim 54, wherein the dry tensile strength of the folded tail exceeds 500 g/in and the caliper thereof exceeds two mils.

63. A roll of tissue product comprising a plurality of sheets of tissue, each sheet separated from the others by lines of perforation, the tail of the roll of tissue product having:

a. a distal portion spaced away from the remainder of the roll;

b. a proximal portion adjoining the remainder of the roll; and c. a medial portion in-between;

the distal portion of the initial sheet being folded inwardly along a transverse fold line, thereby forming a transverse fold and a folded tail tab extending across the distal portion, said distal portion of the initial sheet having a primary adhesive bond;

i) extending over an area overlapping the distal edge of the initial sheet;

ii) adhering the distal and proximal portions of the tail to the next interior sheet of tissue inwardly adjacent thereto;

iii) the strength of the primary adhesive bond being at least about 50 g/3" but no more than about 300 g/3";

iv) said primary adhesive bond joining the innermost of the distal and proximal portions of the tail to the next underlying tissue sheet and penetrating inwardly through the portion of the tail adjacent to said adhesive bond and forming an subsidiary bond adhering the distal and proximal portions of the tail to each other;

the area over which said adhesive bond extends neither spanning nor adjoining a line of perforation joining sheets in the initial four sheets of the roll of tissue product and the medial portion of the tail comprising the folded tail tab having a dry tensile strength of at least 1½ times the strength of the adhesive bond adhering the distal and proximal portions of the tail to the next interior sheet of tissue inwardly adjacent thereto.

64. The roll of tissue product of claim 63 wherein the strength of the primary adhesive bond is at least about 60 g/3" but no more than about 150 g/3", while the strength of the subsidiary bond is no more than about 25 g/3".

65. The roll of tissue product of claim 63, wherein the medial portion of tail comprises the folded tail tab, the folded tail tab having a dry tensile strength of at least 1¼ times the sum of the machine direction dry tensile strength of the tissue product and the strength of the primary adhesive bond.

66. The roll of tissue product of claim 63, wherein the medial portion of the tail comprises the folded tail tab, the folded tail tab having a dry tensile strength of at least twice the strength of the primary adhesive bond.

67. The roll of tissue product of claim 63, wherein the strength of the primary adhesive bond adhering the innermost of the proximal and distal portions of the tail to the next interior sheet of tissue inwardly adjacent thereto is no more than about 75% of the machine direction dry tensile strength of the tissue product.

68. The roll of tissue product of claim 63, wherein the dry tensile strength of the projecting folded over tail exceeds 500 g/in and the caliper thereof exceeds two mils.

69. A roll of tissue product comprising a plurality of sheets of tissue, each sheet separated from the others by lines of perforation, the initial sheet of the roll of tissue product having:

a. a distal portion spaced away from the remainder of the roll;

b. a proximal portion adjoining the remainder of the roll; and c. a medial portion in-between;

the distal portion of the initial sheet being folded along a transverse fold line, thereby forming a transverse fold and a folded tail tab extending across the distal portion, said distal portion of the initial sheet having an adhesive bond;

i) extending over an area overlapping the distal edge of the tail;

ii) adhering the distal and proximal portions of the tail to the next interior sheet of tissue inwardly adjacent thereto;

iii) the strength of the adhesive bond being no more than about 75% of the machine direction dry tensile strength of the tissue product;

iv) the area over which said adhesive bond extends neither spanning nor adjoining a line of perforation joining sheets in the initial four sheets of the roll of tissue product.

70. The roll of tissue product of claim 69, wherein the medial portion of the tail comprises the folded tail tab, the folded tail tab having a dry tensile strength of at least 1½ times the strength of the adhesive bond adhering the distal and proximal portions of the tail to the next interior sheet of tissue inwardly adjacent thereto.

71. The roll of tissue product of claim 69 wherein the medial portion of the tail comprises the folded tail tab, the folded tail tab having a dry tensile strength of at least 1¼ times the sum of the machine direction dry tensile strength of the tissue product and the strength of the adhesive bond adhering the distal and proximal portions of the tail to the next interior sheet of tissue inwardly adjacent thereto.

72. The roll of tissue product of claim 69, wherein the medial portion of the tail comprises the folded tail tab, the folded tail tab having a dry tensile strength of at least twice the strength of the adhesive bond adhering the distal and proximal portions of the tail to the next interior sheet of tissue inwardly adjacent thereto.

73. The roll of tissue product of claim 69, wherein the strength of the adhesive bond adhering the distal and proximal portion of the tail to the next interior sheet of tissue inwardly adjacent thereto is no more than about 75% of the machine direction dry tensile strength of the tissue product.

74. A roll of tissue product comprising a plurality of sheets of tissue, each sheet separated from the others by lines of perforation, the tail of the roll of tissue product having:

a. a distal portion spaced away from the remainder of the roll;

b. a proximal portion adjoining the remainder of the roll; and c. a medial portion in between;

the distal portion of the tail being folded inwardly along a transverse fold line, thereby forming a transverse fold and a folded tail tab extending across the tail, and having an adhesive bond;

i) extending over an area overlapping the distal edge of the tail;

ii) adhering the distal and proximal portions of the tail to the next interior sheet of tissue inwardly adjacent thereto;

iii) the strength of the adhesive bond being no more than about 75% of the machine direction dry tensile strength of the tissue product; and the area over which said adhesive bond extends neither spanning nor adjoining a line of perforation joining sheets in the initial four sheets of the roll of tissue product.

75. The roll of tissue product of claim 74, wherein the medial portion of the tail comprises the folded tail tab, the folded tail tab having a dry tensile strength of at least 1½ times the strength of the adhesive bond adhering the distal and proximal portions of the tail to the next interior sheet of tissue inwardly adjacent thereto.

76. The roll of tissue product of claim 74, wherein the medial portion of the tail comprises the folded tail tab, the folded tail tab having a dry tensile strength of at least 1¼ times the sum of the machine direction dry tensile strength of the tissue product and the strength of the adhesive bond adhering the distal and proximal portions of the tail to the next interior sheet of tissue inwardly adjacent thereto.

77. The roll of tissue product of claim 74, wherein the medial portion of the tail comprises the folded tail tab, the folded tail tab having a dry tensile strength of at least twice the strength of the primary adhesive bond adhering the innermost of the distal and proximal portions of the tail to the next interior sheet of tissue inwardly adjacent thereto.

78. The roll of tissue product of claim 74, wherein the dry tensile strength of the projecting folded tail exceeds 500 g/in and the caliper thereof exceeds two mils.

79. A roll of tissue product comprising a plurality of sheets of tissue, each sheet separated from the others by lines of perforation, wherein:

a. the tail of the roll of tissue product has a distal portion spaced away from the remainder of the roll, a proximal portion adjoining the remainder of the roll and a medial portion in-between;

b. the distal portion of the tail being folded along a transverse fold line, thereby forming a transverse fold and a folded exterior sheet extending across the tail;

c. a primary adhesive bond extends over an area spaced from the distal edge of the tail adheres the innermost of the distal and proximal portions of the tail to the next interior sheet of tissue inwardly adjacent thereto;

d. said primary adhesive bond penetrates and joins distal and proximal portions of the tail to each other;

e. the area over which said primary adhesive bond extends neither spanning nor adjoining a line of perforation joining sheets in the initial four sheets of the roll of tissue product; and f. the medial portion of the tail comprises a folded tail tab having a dry tensile strength of at least 1½ times the strength of the adhesive bond adhering the distal and proximal portions of the tail to the next interior sheet of tissue inwardly adjacent thereto.

80. The roll of tissue product of claim 79 wherein said adhesive penetrates inwardly through the next interior sheet of tissue inwardly adjacent said adhesive bond and forms a secondary bond adhering said next exterior sheet to the sheet underlying said next interior sheet, the strength of said secondary bond being less than the strength of said primary bond.

81. The roll of tissue product of claim 79 wherein said adhesive penetrates inwardly through the next interior sheet of tissue inwardly adjacent said adhesive bond and forms a secondary bond adhering said next exterior sheet to the sheet underlying said next interior sheet, the strength of the secondary bond not exceeding 40 g/3".

82. The roll of tissue product of claim 79, wherein the area over which said adhesive bond extends is spaced from the medial portion of the tail of the roll such that the folded tail tab presented to the user is a projecting folded tail tab.

83. The roll of tissue product of claim 82, wherein the dry tensile strength of the projecting folded tail tab exceeds 400 g/in and the caliper thereof exceeds one mil.

84. The roll of tissue product of claim 82, wherein the dry tensile strength of the projecting folded tail tab exceeds 500 g/in and the caliper thereof exceeds two mils.

85. The roll of tissue product of claim 79, wherein said adhesive penetrates inwardly through the exterior sheet underlying the tissue sheet inwardly adjacent to said adhesive bond and forms an interior subsidiary bond adhering the tissue sheet underlying the tissue sheet inwardly adjacent to said adhesive bond to the tissue sheet underlying the tissue sheet inwardly adjacent to said adhesive bond.

86. The roll of tissue product of claim 79, wherein the strength of the adhesive bond extending over an area spaced from the distal edge of the tail adhering the distal portion of the folded exterior sheet to the exterior of the next interior sheet of tissue inwardly adjacent thereto is at least about 50 g/3" but no more than about 300 g/3", while the strength of the interior subsidiary bond is no more than about 25 g/3".

87. The roll of tissue product of claim 86, wherein said adhesive bond penetrates inwardly through the tissue sheet underlying the tissue sheet inwardly adjacent to said adhesive bond and forms an interior subsidiary bond adhering that tissue sheet to the tissue sheet thereunder.

88. The roll of tissue product of claim 79, wherein each adhesive bond adhering a tissue sheet underlying the tissue sheet inwardly adjacent to said adhesive bond to the tissue sheet outwardly adjacent thereto neither spans nor adjoins a line of perforation joining sheets in the initial six sheets of the roll of tissue product.

89. The roll of tissue product of claim 79, wherein each adhesive bond adhering a tissue sheet underlying a tissue sheet inwardly adjacent to said adhesive bond to a tissue sheet outwardly adjacent thereto neither spans nor adjoins a line of perforation joining sheets in the initial eight sheets of the roll of tissue product.

90. The roll of tissue product of claim 79, wherein the strength of the adhesive bond extending over an area spaced from the distal edge of the tail adhering the innermost of the distal and proximal portions of the tail to the next interior sheet of tissue inwardly adjacent thereto is at least about 50 g/3" but no more than about 300 g/3".

91. The roll of tissue product of claim 79, wherein the strength of the adhesive bond extending over an area spaced from the distal edge of the tail adhering the innermost of the distal and proximal portions of the tail to the next interior sheet of tissue inwardly adjacent thereto is at least about 60 g/3" but no more than about 200 g/3".

92. The roll of tissue product of claim 79, wherein the strength of the adhesive bond extending over an area spaced from the distal edge of the tail adhering the innermost of the proximal and distal portions of the tail to the next interior sheet of tissue inwardly adjacent thereto is at least about 60 g/3" but no more than about 150 g/3".

93. The roll of tissue product of claim 79, wherein the strength of the adhesive bond extending over an area spaced from the distal edge of the tail adhering the innermost of the proximal and distal portions of the tail to the next interior sheet of tissue inwardly adjacent thereto is at least about 60 g/3" but no more than about 120 g/3".

94. The roll of tissue product of claim 79, wherein the strength of the adhesive bond extending over an area spaced from the distal edge of the tail adhering the innermost of the proximal and distal portions of the tail to the next interior sheet of tissue inwardly adjacent thereto is at least about 70 g/3" but no more than about 110 g/3".

95. The roll of tissue product of claim 79, wherein the medial portion of tail comprises the folded tail tab, the folded tail tab projecting from the roll body by from at least about ¼" up to about 2¼".

96. The roll of tissue product of claim 95, wherein said adhesive bond penetrates inwardly through the tissue sheet underlying the tissue sheet inwardly adjacent to said adhesive bond and forms an interior subsidiary bond adhering that tissue sheet to the sheet thereunder.

97. The roll of tissue product of claim 79, wherein the medial portion of the tail comprises the folded tail tab, the folded tail tab having a dry tensile strength of at least 1¼ times the sum of the machine direction dry tensile strength of the tissue product and the strength of the adhesive bond adhering the innermost of the distal and proximal portions of the tail to the next interior sheet of tissue inwardly adjacent thereto.

98. The roll of tissue product of claim 79, wherein the medial portion of the tail comprises the folded tail tab having a dry tensile strength of at least twice the strength of the adhesive bond adhering the innermost of the proximal and distal portions of the folded exterior sheet to the next interior sheet of tissue inwardly adjacent thereto.

99. The roll of tissue product of claim 79, wherein the strength of the adhesive bond adhering the innermost of the proximal and distal portions of the tail to the next interior sheet of tissue inwardly adjacent thereto is no more than about 75% of the machine direction dry tensile strength of the tissue product.

100. The roll of tissue product of claim 79, wherein the area of said adhesive bond is approximately the width of the roll and extends from about ⅛" to about ½" in the machine direction.

101. A roll of tissue product comprising a plurality of sheets of tissue, each sheet separated from the others by lines of perforation, wherein:

a. the initial sheet of the roll of tissue product has a distal portion spaced away from the remainder of the roll, a proximal portion adjoining the remainder of the roll and a medial portion in-between;

b. the distal portion of the tail being folded along a transverse fold line, thereby forming a transverse fold extending across the tail;

c. an adhesive bond extends over an area overlapping the distal edge of the tail adhering both the distal and proximal portions of the tail to the exterior of the next interior sheet of tissue inwardly adjacent thereto;

d. the area over which said adhesive bond extends neither spanning nor adjoining a line of perforation joining sheets in the initial four sheets of the roll of tissue product; and e. the medial portion of the tail comprises a folded tail tab having a dry tensile strength of at least 1½ times the strength of the adhesive bond adhering the distal and proximal portions of the tail to the next interior sheet of tissue inwardly adjacent thereto.

102. The roll of tissue product of claim 101 wherein said adhesive bond also penetrates inwardly through the next interior sheet of tissue inwardly adjacent said adhesive bond and forms a secondary bond adhering said next exterior sheet to the sheet underlying said next interior sheet.

103. The roll of tissue product of claim 101 wherein said adhesive bond penetrates inwardly through the next interior sheet of tissue inwardly adjacent said adhesive bond and forms a secondary bond adhering said next exterior sheet to the sheet underlying said next interior sheet, the strength of the secondary bond not exceeding 25 g/3".

104. The roll of tissue product of claim 101, wherein the area over which said adhesive bond extends is spaced from the medial portion of the tail of the roll such that the folded tail tab presented to the user is a projecting folded tail tab.

105. The roll of tissue product of claim 104, wherein the dry tensile strength of the projecting folded tail tab exceeds 400 g/in and the caliper thereof exceeds one mil.

106. The roll of tissue product of claim 104, wherein the dry tensile strength of the projecting folded tail tab exceeds 500 g/in and the caliper thereof exceeds two mils.

107. The roll of tissue product of claim 101, wherein said adhesive bond penetrates inwardly through the exterior sheet underlying the tissue sheet inwardly adjacent to said adhesive bond and forms an interior subsidiary bond adhering the tissue sheet underlying the tissue sheet inwardly adjacent to said adhesive bond to the tissue sheet underlying the tissue sheet inwardly adjacent to said adhesive bond.

108. The roll of tissue product of claim 101, wherein the strength of the adhesive bond extending over an area spaced from the distal edge of the tail adhering the distal and proximal portions of the tail to the exterior of the next interior sheet of tissue inwardly adjacent thereto is at least about 50 g/3" but no more than about 300 g/3", while the strength of the interior subsidiary bond is no more than about 40 g/3".

109. The roll of tissue product of claim 108, wherein said adhesive penetrates inwardly through the tissue sheet underlying the tissue sheet inwardly adjacent to said adhesive bond and forms an interior subsidiary bond adhering that tissue sheet to the tissue sheet thereunder.

110. The roll of tissue product of claim 101, wherein each adhesive bond adhering a tissue sheet underlying the tissue sheet inwardly adjacent to said adhesive bond to the tissue sheet outwardly adjacent thereto neither spans nor adjoins a line of perforation joining sheets in the initial six sheets of the roll of tissue product.

111. The roll of tissue product of claim 101, wherein each adhesive bond adhering a tissue sheet underlying a tissue sheet inwardly adjacent to said adhesive bond to a tissue sheet outwardly adjacent thereto neither spans nor adjoins a line of perforation joining sheets in the initial eight sheets of the roll of tissue product.

112. The roll of tissue product of claim 101, wherein the strength of the adhesive bond extending over an area spaced from the distal edge of the tail adhering the distal and proximal portions of the tail to the next interior sheet of tissue inwardly adjacent thereto is at least about 50 g/3" but no more than about 300 g/3".

113. The roll of tissue product of claim 101, wherein the strength of the adhesive bond extending over an area spaced from the distal edge of the initial sheet adhering the distal and proximal portions of the tail to the next interior sheet of tissue inwardly adjacent thereto is at least about 60 g/3" but no more than about 200 g/3".

114. The roll of tissue product of claim 101, wherein the strength of the adhesive bond extending over an area spaced from the distal edge of the tail adhering the distal and proximal portions of the tail to the next interior sheet of tissue inwardly adjacent thereto is at least about 60 g/3" but no more than about 150 g/3".

115. The roll of tissue product of claim 101, wherein the strength of the adhesive bond extending over an area spaced from the distal edge of the tail adhering the distal and proximal portions of the tail to the next interior sheet of tissue inwardly adjacent thereto is at least about 60 g/3" but no more than about 120 g/3".

116. The roll of tissue product of claim 101, wherein the strength of the adhesive bond extending over an area spaced from the distal edge of the tail adhering the distal and proximal portions of the tail to the next interior sheet of tissue inwardly adjacent thereto is at least about 70 g/3" but no more than about 110 g/3".

117. The roll of tissue product of claim 101, wherein the medial portion of the tail comprises a folded tail tab projecting from the roll body by from at least about ¼" up to about 2¼".

118. The roll of tissue product of claim 101, wherein the folded tail tab projects from the roll body by from at least about ¼" up to about 2¼".

119. The roll of tissue product of claim 101, wherein the folded tail tab has a dry tensile strength of at least 1¼ times the sum of the machine direction dry tensile strength of the tissue product and the strength of the adhesive bond adhering the innermost of the proximal and distal portions of the tail to the next interior sheet of tissue inwardly adjacent thereto.

120. The roll of tissue product of claim 101, wherein the folded tail tab has a dry tensile strength of at least twice the strength of the adhesive bond adhering the innermost of the proximal and distal portions of the tail to the next interior sheet of tissue inwardly adjacent thereto.

121. The roll of tissue product of claim 101, wherein the strength of the adhesive bond adhering the innermost of the proximal and distal portions of the tail to the next interior sheet of tissue inwardly adjacent thereto is no more than about 75% of the machine direction dry tensile strength of the tissue product.

122. The roll of tissue product of claim 101, wherein the area of said adhesive bond is approximately the width of the roll and extends from about ⅛" to about ½" in the machine direction.

123. A roll of tissue product comprising a plurality of sheets of tissue, each sheet separated from the others by lines of perforation, the tail of the roll of tissue product having:

a. a distal portion spaced away from the remainder of the roll;

b. a proximal portion adjoining the remainder of the roll; and c. a medial portion in-between;

the distal portion of the tail being folded transversely, thereby forming a transverse fold and a folded tail tab extending across the tail, said folded tail tab having an adhesive bond;

i) extending over an area of the distal and proximal portions of the tail;

ii) adhering the distal and proximal portions of the tail to the exterior of the next interior sheet of tissue inwardly adjacent thereto;

iii) the strength of the adhesive bond being at least about 50 g/3" but no more than about 300 g/3";

the area over which said adhesive bond extends neither spanning nor adjoining a line of perforation joining sheets in the initial four sheets of the roll of tissue product and the medial portion of the tail comprising the folded tail tab, the folded tail tab having a dry tensile strength of at least 1½ times the strength of the adhesive bond adhering the distal and proximal portions of the tail to the next interior sheet of tissue inwardly adjacent thereto.

124. The roll of tissue product of claim 123, wherein the strength of the adhesive bond extending over an area of the distal portion of the tail adhering the distal and proximal portions of the tail to the exterior of the next interior sheet of tissue inwardly adjacent thereto is at least about 60 g/3" but no more than about 200 g/3".

125. The roll of tissue product of claim 123, wherein the strength of the adhesive bond extending over an area of the distal portion of the tail adhering the distal and proximal portions of the tail to the exterior of the next interior sheet of tissue inwardly adjacent thereto is at least about 60 g/3" but no more than about 150 g/3".

126. The roll of tissue product of claim 123, wherein the strength of the adhesive bond extending over an area of the distal portion of the tail adhering the distal and proximal portions of the tail to the exterior of the next interior sheet of tissue inwardly adjacent thereto is at least about 60 g/3" but no more than about 120 g/3".

127. The roll of tissue product of claim 123, wherein the strength of the adhesive bond extending over an area of the distal portion of the tail adhering the distal and proximal portions of the tail to the exterior of the next interior sheet of tissue inwardly adjacent thereto is at least about 70 g/3" but no more than about 110 g/3".

128. The roll of tissue product of claim 123, wherein the folded tail tab has a dry tensile strength of at least 1¼ times the sum of the machine direction dry tensile strength of the tissue product and the strength of the adhesive bond adhering the distal and proximal portions of the tail to the exterior of the next interior sheet of tissue inwardly adjacent thereto.

129. The roll of tissue product of claim 123, wherein the folded tail tab has a dry tensile strength of at least twice the strength of the adhesive bond adhering the distal and proximal portions of the tail to the exterior of the next interior sheet of tissue inwardly adjacent thereto.

130. The roll of fly tissue product of claim 123, wherein the strength of the adhesive bond adhering the distal and proximal portions of the tail to the exterior of the next interior sheet of tissue inwardly adjacent thereto is no more than about 75% of the machine direction dry tensile strength of the tissue product.

131. The roll of tissue product of claim 123, wherein the dry tensile strength of the folded tail tab exceeds 500 g/in and the caliper thereof exceeds two mils.

132. A roll of tissue product comprising a plurality of sheets of tissue, each sheet separated from the others by lines of perforation, wherein:

a. the free end of the roll of tissue product has a distal portion spaced away from the remainder of the roll, a proximal portion adjoining the remainder of the roll and a medial portion in-between;

b. the distal portion of the free end being folded along a transversely extending fold line, thereby forming a tail seal tab extending across the distal portion;

c. an adhesive bond extending over an area overlapping the distal edge of the free end adhering the distal portion thereof to the next interior sheet of tissue adjacent thereto;

d. said adhesive bond penetrating outwardly through both the distal portion of the folded free end and the proximal portion of the free end;

e. the area over which said adhesive bond extends neither spanning nor adjoining a line of perforation joining sheets in the initial four sheets of the roll of tissue product; and f. the medial portion of the tail comprises a folded tail seal tab having a dry tensile strength of at least 1½ times the strength of the adhesive bond adhering the distal and proximal portions of the tail to the next interior sheet of tissue inwardly adjacent thereto.

133. The roll of tissue product of claim 132, wherein the area over which said adhesive bond extends is spaced from the medial portion of the free end of the roll such that the folded tail seal tab presented to the user is a projecting tail seal tab.

134. The roll of tissue product of claim 133, wherein the dry tensile strength of the projecting folded tail seal tab exceeds 400 g/in and the caliper thereof exceeds one mil.

135. The roll of tissue product of claim 133, wherein the dry tensile strength of the projecting folded tail seal tab exceeds 500 g/in and the caliper thereof exceeds two mils.

136. The roll of tissue product of claim 133, wherein said tissue product is a multi-ply tissue product and said adhesive penetrates inwardly through the exterior ply of the tissue sheet underlying the tissue sheet inwardly adjacent to said adhesive bond and forms an interior subsidiary bond adhering the exterior ply of the tissue sheet underlying the tissue sheet adjacent to said adhesive bond to the interior ply of the tissue sheet underlying the tissue sheet adjacent to said adhesive bond.

137. The roll of tissue product of claim 133, wherein the folded tail seal tab projects from the roll body by from at least about ¼" up to about 2¼".

* * * * *